US006439657B1

(12) United States Patent
Tholkes

(10) Patent No.: US 6,439,657 B1
(45) Date of Patent: Aug. 27, 2002

(54) SYNERGISTIC BODY POSITIONING AND DYNAMIC SUPPORT SYSTEM

(76) Inventor: Alan L. Tholkes, c/o Health Postures, Inc., 12372 River Ridge Blvd., Burnsville, MN (US) 55337

( * ) Notice: Subject to any disclaimer, the term of this patent is extended or adjusted under 35 U.S.C. 154(b) by 0 days.

(21) Appl. No.: 09/513,374

(22) Filed: Feb. 25, 2000

Related U.S. Application Data

(63) Continuation-in-part of application No. 09/257,900, filed on Feb. 25, 1999.

(51) Int. Cl.[7] ..... A47B 39/00

(52) U.S. Cl. ..... 297/172; 297/135; 297/344.19; 297/339; 297/423.12

(58) Field of Search ..... 297/172, 187, 297/423.11, 423.12, 423.26, 174, 301.1, 135, 344.19, 423.13, 311, 337, 338, 339, 340, 344.12, 354.1, 354.11, 313, DIG. 10, 354.12; 312/223.3

(56) References Cited

U.S. PATENT DOCUMENTS

| | | | | |
|---|---|---|---|---|
| 520,702 A | * | 5/1894 | Palmberg | 297/172 |
| 3,599,962 A | * | 8/1971 | Henry | 297/172 X |
| 4,552,404 A | | 11/1985 | Congleton | |
| 4,736,982 A | | 4/1988 | Hwang | |
| 4,741,547 A | | 5/1988 | Tholkes | |
| 4,765,684 A | | 8/1988 | Kavalheim et al. | |
| 4,898,103 A | | 2/1990 | Pontoppidan et al. | |
| 5,054,852 A | * | 10/1991 | Tholkes | 297/172 |
| 5,119,078 A | | 6/1992 | Grant | |
| 5,149,174 A | | 9/1992 | Charash | |
| 5,186,519 A | | 2/1993 | Larson | |
| 5,199,360 A | | 4/1993 | Koistinen | |
| 5,470,041 A | | 11/1995 | Cucinotta | |
| 5,484,151 A | | 1/1996 | Tholkes | |
| 5,522,641 A | * | 6/1996 | Infanti | 297/172 X |
| 5,542,746 A | * | 8/1996 | Bujaryn | 297/172 X |
| 5,584,586 A | | 12/1996 | Gurin et al. | |
| 5,697,668 A | * | 12/1997 | Chao | 297/172 |
| 5,765,910 A | * | 6/1998 | Larkin et al. | 297/172 |
| 5,823,120 A | | 10/1998 | Holmquist | |

FOREIGN PATENT DOCUMENTS

EP 0 513 838 A 11/1992

OTHER PUBLICATIONS

CTDNEWS, Supplement to CTDNEWS: Prevention, LRP Publications, vol. 7, No. 9, Sep. 1998.

*The Power of Being First*, Neutral Posture, Ergonomics, Inc., brochure, undated.

* cited by examiner

*Primary Examiner*—Peter M. Cuomo
*Assistant Examiner*—Stephen Vu
(74) *Attorney, Agent, or Firm*—Patterson, Thuente, Skaar & Christensen, P.A.

(57) ABSTRACT

An adjustable height work station is adjustable between a seated work level and a lifted work level. The work station includes a base structure, a work area, and a lift arm. The work area incorporates a substantially planar surface. The lift arm has a first end and a second end. The first end is pivotally secured to the base structure while the second end is pivotally secured to the work area. Tie first end and second end are pivotable through a range of motion to raise and lower the work area between the seated work level and the lifted work level while maintaining the planar surface of the work area in a substantially horizontal position through the range of motion.

13 Claims, 29 Drawing Sheets

57
56
58
12
54
60
50
36
64
62
68
39
38
42
14
27
15
16
26
10
18
23
48
24
22

57
56
58
51
46
54
64
62
60
68
61
42
27
26
102
20
104
24
23
22

SYNERGISTIC BODY POSITIONING AND DYNAMIC SUPPORT SYSTEM

CLAIM TO PRIORITY

The present application is a continuation-in-part application of U.S. patent application Ser. No. 09/257,900, entitled "Synergistic Body Positioning and Dynamic Support System", filed Feb. 25, 1999, and claims priority thereto. U.S. patent application Ser. No. 09/257,900 is hereby incorporated by reference.

BACKGROUND OF INVENTION

1. Field of the Invention

The present invention generally relates to a body positioner structured to provide healthy postures by promoting active sitting and proactive positioning. The positioner enables accurate and repeatable correlation between a user's body and a work station by enabling quick postural adjustments based on the preferred postural excursions of the user. Particularly, the body positioner is preferably integrated with at least one work station such as, for example, a computer or manufacturing station. More particularly, the invention provides integration of the positioner with a seating task station, enabling quick dynamic adjustments for optimal alignment and orientation of the positioner and the user relative to the seating task station within a plurality of healthy postures and ergonomic ranges to promote worker health, comfort and productivity.

2. Description of Related Art

In the early 1970's Jerome Congleton, a leading ergonomist, was the first to introduce the concept of the neutral position to the task seating industry. Further, A. C. Mandal, in a book relating to unhealthy postures of school children, emphasized the need to tilt the pelvis forward in order to maintain a proper balance of the weight of the upper body on the spine. These and other ergonomic research over the last three decades have shown that certain postural orientations, particularly during sitting, affect the body weight distribution on the spine and generally result in injury or long term pain. For the most part therefore, ergonomic research over the past three decades appears to support the concept of proper body weight distribution by maintaining certain postures. However, heretofore, no system exists which would enable a person, particularly engaged in work involving task seating systems and related operations, to shift into comfortable positions, quickly without disrupting work.

Several medical studies have shown that prolonged static postures in any of the natural configurations such as, for example, sitting and standing cause discomfort, pain and ultimately injury. Modern work stations such as computer related work at the office require that the operator be oriented in a sedentary position. When a subject is in a limited movement sitting position muscle stress and discomfort set in. Specifically, during sitting, the vertebral column transmits the weight of the body through the pelvis to the lower limbs. When the vertebral column experiences prolonged stress due to sedentary postures, a deformity of the spine may result leading to serious medical problems such as kyphosis which is characterized by a posterior curvature of the vertebral column. Further, prolonged sedentary sitting may contribute and/or aggravate scoliosis, characterized by a lateral curvature of the vertebral column and lordosis, characterized by an anterior curvature of the vertebral column. Movements of the vertebral column are freer in the cervical and lumbar regions and these regions are the most frequent sites of aches. The main movements of the vertebral column are flexion or forward bending, extension or backward bending, lateral bending or lateral flexion, and rotation or twisting of the of the vertebra relative to each other. Some circumduction which consists of flexion-extension and lateral bending also occurs. It is imperative, therefore, that a body positioning system provide movement, at the very least, to the cervical and lumbar regions of the vertebral column.

In addition to the vertebral column, a body support system implemented to position a person proximal to a work station must be ergonomically balanced with the work station. In this regard the upper limb, which is the organ of manual activity, should be allowed to move freely. Further, the upper limb which includes the shoulder, arm, forearm and hand must be positioned to provide stability and to gain mobility. Because any slight injury to the upper limb is further aggravated by repeated motion of the hand and arm muscles, it is important to provide comfortable positioning and support to the upper limb at all postures related to a task seating work station.

Similarly, a well-designed body support system should consider neck and head position. The neck contains vessels, nerves, and other structures connect in the head and the trunk. There are several causes of neck pain. As it relates to neck pain resulting from bad postures, muscle strain and protrusion of a cervical intervertebral disc may be the cause. Many vital structures are located in the neck and proper positioning and support of the neck must be made to avoid muscle strain. Further, posterior positioning to the head is important to avoid strain, headache and head pain.

Thoracic support is also vital to promote good breathing and elimination of stress on the thoracic vertebrae. As is well known clinically, the lungs are the essential organs of respiration. The inspired air is brought in close relationship to the blood in the pulmonary capillaries. Thus, proper positioning and thoracic support enhances the efficiency of the lings to supply optimal oxygen levels to the blood. This is key to worker overall health and productivity.

The lower limb is the organ of locomotion and is also a load bearing element. The parts of the lower limb are comparable to those of the upper limb. The lower limb is heavier and stronger than the upper limb. Since a vast number of vital networks of arterial vessels are located in the lower limb, it is clinically important to promote the flow of blood through these arterial vessels. Thus, in sedentary postures, frequent removal of weight off the lower limb is recommended to eliminate muscle tension, fatigue and related degenerative joint disease.

In general, the present state of the art is incapable of providing users with the option to switch to different comfortable/healthy postures while keeping them within an ergonomic range of a work station in a manner that is non-disruptive to the task being performed. Particularly, the current state of the art does not provide an "active sitting and proactive positioning" system which incorporates the support of the various body parts and promotes healthy postures and comfort at work stations.

Accordingly, there is a need for a body positioning system capable of providing fluidic and timely transposition of a user into various preferred and healthy postural configurations, to maintain comfortable ergonomic ranges to a task seating work station at all postures and enhance health and productivity relative to a defined space-volume envelope of the positioning system and, preferably to a work station integrated therewith.

SUMMARY OF THE INVENTION

The present invention is based on the heretofore unrealized objective to successfully integrate human performance with comfort and health. Specifically, in the preferred embodiment, the invention implements principles of "active sitting and proactive positioning" in which the subject is temporally encouraged to change to various comfort and health postures while maintaining ergonomically compatible access and reach to a work station at all times.

The invention provides a user with a selection of discrete and dynamic medically preferred health postures. Specifically, the invention utilizes, inter alia the principle that to prevent cumulative trauma disorder (CTD) the pelvis must always be positioned in an orientation similar to an erect/tilted position during standing. The basic discrete postures of the present invention include a recline seated posture, a recline neutral posture/breath-easy posture and a recline standing posture. The invention incorporates these discrete postures to generate a full range of dynamic hybrid postures continuously shiftable and adjustable to prevent injury, discomfort and fatigue while enhancing health and comfort. Further, the invention proactively positions the user to be placed within an ergonomic range of the work station, at all postural configurations to enhance productivity.

The invention enables the user to move in and out of the discrete and dynamic postures without disrupting the task at hand. One of the significant benefits derived from this active sitting aspect of the invention is that the user is provided with a full range of joint movement in the legs and torso during the excursion through the various postures. Further, the postures enhance the respiratory system and relieve muscle stress. The user may also perform occasional stretch exercises, by shifting through these various postures to increase vital fluid flow and circulation in the torso and lower parts of the body.

The invention includes a body positioning system having components designed to be compatible with human physiology and enhancement of healthy postures at work stations. Specifically, the major components include a seat/back support, a body support component for below the knee, and a foot rest body support all being independently and correlatively operable at the option(s) of the user to navigate through various postures while maintaining ergonomic reach to the work station. More specifically, the seat/back support and the support for below the knee comprise pressure surfaces having ergonomically optimized/compatible geometric shapes to enable a smooth transition from one posture to the next in addition to the provision of proper body support and healthy positions at all postural configurations. Further, the surfaces are made of materials specifically structured to eliminate excessive resistance, during the user's dynamic excursions through the various postures or during any static posture, irrespective of the type and fabric of clothing worn by the user. Since the pressure surfaces/bearing surfaces are implemented to shiftably serve as back and seat support at various postures, the interaction between the surfaces and the user's clothing is critical to promote smooth transition of the user from one posture to the other.

The controls and actuators implemented in the present invention, which control the body positioning system seat/back angle adjustment, seat height adjustment and lower body part support angle adjustment, are ergonomically designed to have a high level of accessibility and availability to the user. Further, the actuators are set to meet the anthropometric fit requirements of a world population. Particularly, the controls are designed and located to enable a user to quickly and easily shift from one posture to another without disruption of the task being performed.

The present invention further provides robust features integrated to enhance productivity and worker effectiveness. The user is generically integrated with the positioning system and work station such that all the components are positioned to be readily accessible and available to the user while enabling work to progress concurrent with multiple posture position shifting. Further, the work station is designed to attenuate the transfer of vibration to the positioner by strategically installing vibration dampeners and shock absorbing connections at points of contact between the user, the work station, work tools, and the positioner.

The office environment is one of the many work areas in which the present invention could be advantageously implemented. The body positioning system is dimensionally optimized to fit into most office space and is highly mobile to be compatible with movable wall offices. Further, the system of the present invention is modularized to stand alone or to be built into multiple work station areas.

In the preferred embodiment, the controls and mechanical systems are versatile to adapt to various power supply systems. Further, ease of assembly and disassembly make the system advantageously flexible to accommodate the user's choices and be compatible with various production and work area environments.

With these and other features, advantages and objects of the present invention which may become apparent, the various aspects of the invention may be more clearly understood by reference to the following detailed description of the preferred embodiment, the appended claims and to the several drawings herein contained.

DESCRIPTION OF THE PREFERRED EMBODIMENTS

The present invention is able to anticipate the various shifts in weight and pressure normally encountered by the body when an individual changes from one posture to another. More particularly, the invention mimics ergonomically desirable postural silhouettes to proactively support and position the user in the most healthy posture, such that body weight and pressure are distributed to eliminate undue discomfort, pain, fatigue, and muscular and skeletal strain. Thus, one of the significant features of the present invention is the elimination of discomfort and potential injury caused by most sitting postures when the individual is forced to sit in an upright posture or other unhealthy postures for an extended time period.

Figure 1:
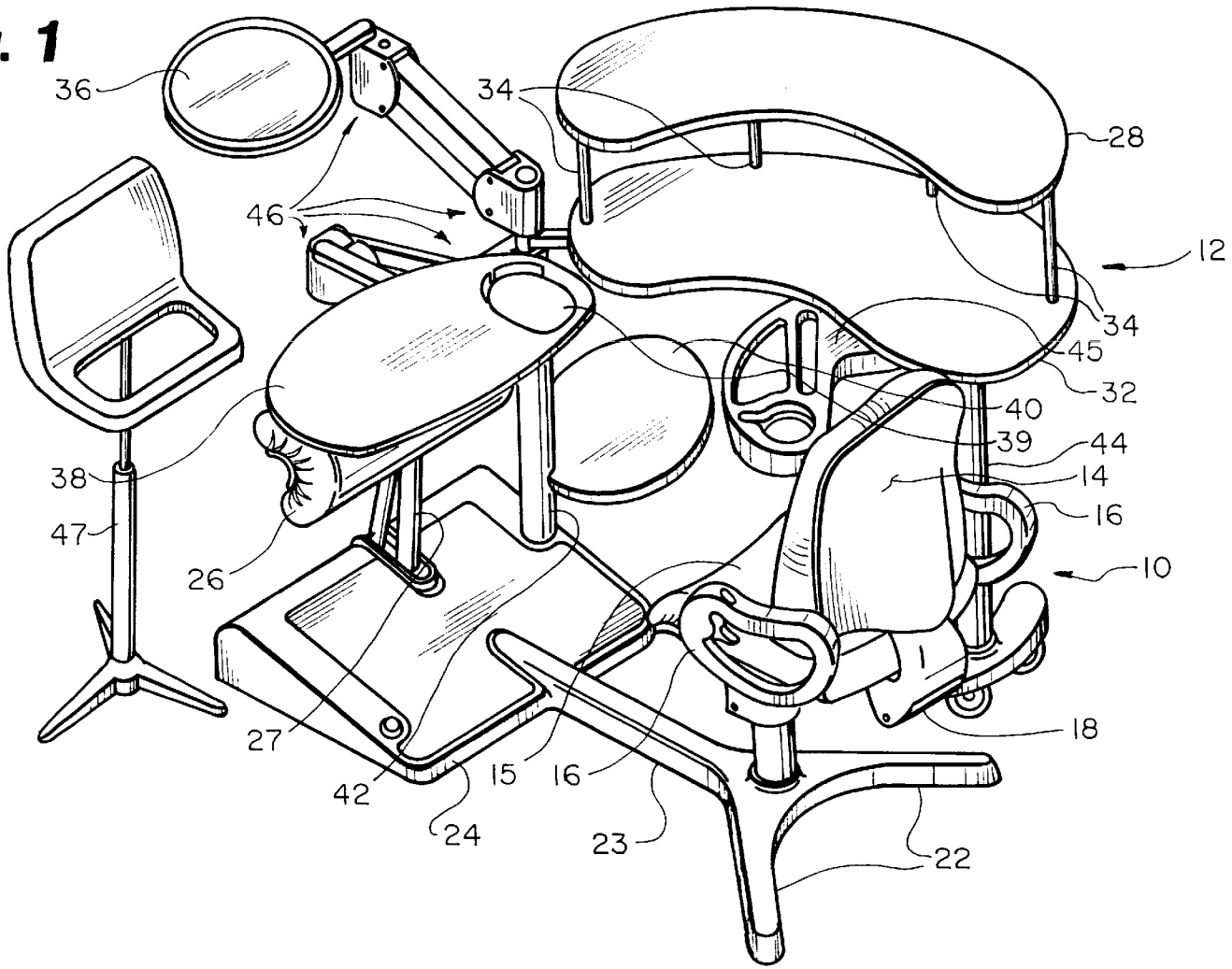
FIG. 1 is an isometric view assembly drawing of the preferred embodiment.

With reference to FIG. 1, a perspective assembly view is shown of the present invention. In particular, the body positioning system 10 is shown integrated with work station 12. As depicted herein, work station 12 is a computer work station where any type of computer, small enough to fit on an office desk, is implemented. A desktop computer may be connected to the local area network and configured with sufficient memory and storage to perform standard or specialist business computing tasks. Current technology offers full-function desktop computers which can be turned into portable notebook computers. When in the office, the small computer sits in a docking station and can connect to a local area network. Although body positioning system 10 can be used independently, FIG. 1 shows one of the preferred embodiments in which a computer work station 12 is integrated with it. Specifically, the computer work station 12 includes support surfaces and structures for a monitor, keyboard and a central processing unit (CPU). As discussed hereinbelow, the integrated system is designed not only to promote clinically advantageous ergonomic postures but incorporates bio-mechanical design features to eliminate any physical discomfort caused by eye strain, muscle stress, and improper spinal configuration during long term task activity at computer work station 12. Further, the present invention provides a user with a selection of discrete and dynamic medically preferred health postures based on a coordinated, accurate and repeatable orientation of body positioning system 10 and work station 12. More specifically, a plurality of basic discrete postures including a recline seated posture, a recline neutral posture/breath-easy posture, and a recline standing posture are implemented to set a user at positioning system 10 at various orientations. The discrete postures are a distinct part of a full range of dynamic hybrid postures continuously shiftable and adjustable to prevent injury, discomfort and fatigue while enhancing health and comfort. The invention utilizes ease of adjustment and proactively motivates the operator/user to be positioned within an ergonomic range of work station 12 during all postures, thus enhancing health and productivity. As will be discussed hereinbelow, one of the advantages of the proactive aspect of the invention is the structural cooperation of the elements of positioning system 10 and work station 12 to advance, favor, promote motion and nimble transformation of the user from one posture to the next. Particularly, positioning system 12 is a synergistic bio-mechanical system designed to anticipate and become synergistic with the next best postural orientation of the human body ranging from a convention seated, with full body stretch option, to a lean-stand with the full body in a substantially vertical posture.

Still referring to FIG. 1 in more detail, an integrated body positioning and work station system is shown. Specifically, body positioning system 10 and work station 12 are shown integrated to correlatively operate as an integrated unit. Positioning system 10 includes pressure bearing surfaces 14 and 15 and a pair of articulating side supports 16. Pressure bearing surfaces 14 and 15 are adjustably and resiliently attached at joint 18. Pressure bearing surface 14 includes a contact surface (back support) and outer formed surface to encase reinforcing frames therein. The inner surface includes geometric shapes to cradle the user as lumbar, lower back and shoulder blade regions during sitting, neutral and lean-stand positions, and the several postures in between. The outer surface is preferably removable and is centrally cumbered to encase an upper end section of joint 18 which is secured to outer surface of pressure bearing surface 14. Further, articulating side supports 16 are attached to pressure bearing surface 15. Pressure bearing surface 15 is rotatably and tiltably connected to a top end of pedestal 20. Pressure bearing surface 15 includes an upper and lower formed surfaces. The upper part of pressure bearing surface 15, which functions as a seat and back support depending upon the user's temporal posture, generally includes a declivity with anticlined arcuate edges at opposite sides. This geometric shape of surface 15 provides a biomedical system which articulates with the user's body to effectively support the gluteal and lumbosacral regions. At its bottom end, pedestal 20 is pivotally and adjustably secured to stabilizers 22 and connector arm 23. Connector arm 23 interconnects stabilizers 22 with base structure 24. Lower body support pad 26 including link member 27 are mounted on base structure 24.

Work station 12 includes tool platforms 28 and 32 separated by connection members 34. Further, work station 12 includes platforms 36, 38, and 40 hingably and adjustably connected to column 42. Swivel mounted leg 44 provides support to tool platforms 28 and 32 at the fore end. Platform 45, formed to support coffee cups, cans and similar containers in addition to writing tools, is adjustably and swingably mounted on swivel mounted work surface 32. Mouse cage 39 is set on platform 38 where a keyboard is preferably located. As will be discussed hereinbelow, the platforms are adjustably interconnected by utilizing maneuverable compound linkage framework 46. Specifically, as will be disclosed hereinbelow, when body positioning system 10 is translated through various postural positions, work station 12 is accurately and continuously maintained within the ergonomic range of the user by timely manipulating compound linkage framework 46. Work station 12 preferably includes file holder 47 which is designed to be compatible with the many ergonomic features of the present invention.

Figure 2:
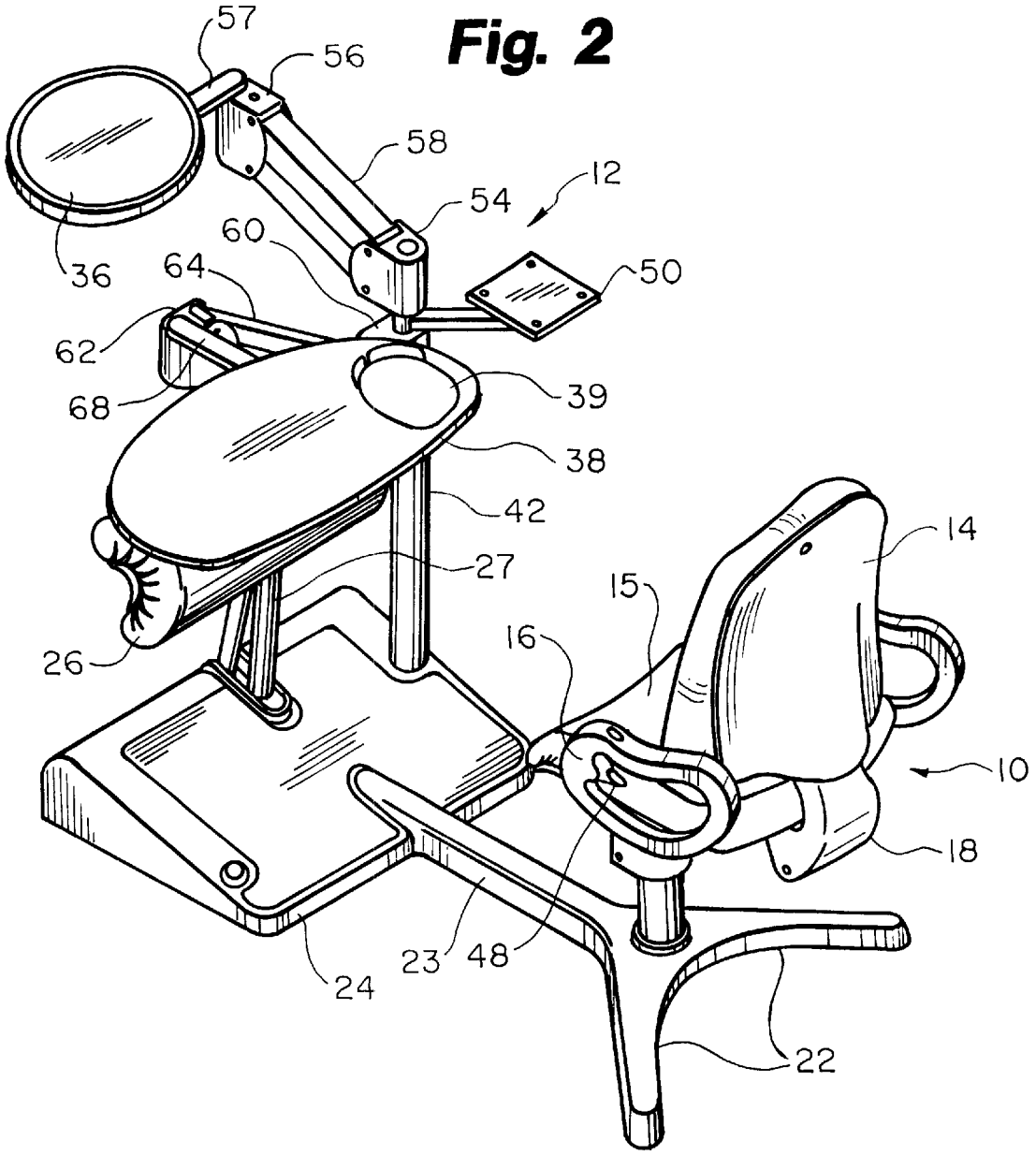
FIG. 2 is an isometric view describing in greater detail correlatively adjustable joints and links.

Referring next to FIG. 2, a portion of work station 12 is removed to clearly show some of the major interactive elements of the invention. Particularly, body positioning system 10 is shown with triggers 48 embedded in articulating side supports 16. Triggers 48 are located immediately forward under the declivity of articulating arm 16. This arrangement proactively encourages the user to keep the elbows backwards thus pushing the thorax forward. As the user actuates triggers 48, the thorax is extended anteriorily and this in turn tilts the pelvis forward throughout the various postural excursions of the user. This is one of the many distinguishing features of the present invention. Prior art devices, such as ergonomic chairs and supports, are generally designed to locate and provide lumbar support. In sharp contrast, the present invention enables the pelvis to be tilted forward irrespective of the position of the lumbar curve. Each basic posture of the present invention leans the upper body back about 15° beyond the vertical. This allows all of the upper body weight to be distributed throughout pressure bearing surfaces 14 and 15 while platforms 36 and 38 are moved to easily accessible positions. In the preferred embodiment, platform 36 is used to support a screen/monitor or similar device, and as indicated above, a keyboard is placed on platform 38. Mouse cage 39 includes a pad and a structure to retain the mouse in place when platform 38 is shifted laterally and tilted toward or away from positioning system 10. The tiltability/rotatability of platform 38 is one of the many innovative and biomechanical features of the invention. Platform 38 is independently tiltable to conform to the many various orientations of the user. Specifically, when the user is in stand/near stand or lean/stand, posture platform 38 is inclined away from positioning system 10 to provide an ergonomically healthy and non-stressful positioning of the hands. Platform 38 is rotatable toward and away from positioning system 10 to eliminate positions of the hand which may cause compression of the median nerve at specific postures. Generally, a prolonged compression of the median nerve will likely result in Carpal Tunnel Syndrome which results in a progress loss of coordination and strength in the thumb if the cause of the median nerve compression is not alleviated. This further results in difficulty in performing fine movements. In cases of severe compression of the median nerve, there is a likely risk of atrophy of some of the muscles in the hand. Yet another innovative aspect of the present invention is mouse cage 39 which is designed to secure the mouse to be accessible and available at any of the positions of platform 38.

Still referring to FIG. 2, support plate 50 is shown cantilevered from link arm 49. Further, link arm 49 is secured to a telescoping section of support column 42. Support plate 50 is adjustably pivotably and provides support for tool platforms 28 and 32 at the rear end. Compound linkage framework 46 includes flex joints 54 and connected to intermediate members 58. Platform 36 is cantilevered at joint 37 via flex joint 56. Further, compound linkage framework 46 includes flex joints 60 and 62 connected to intermediate members 64. Platform 38 is cantilevered at joint 68 via flex joint 62.

Figure 3:
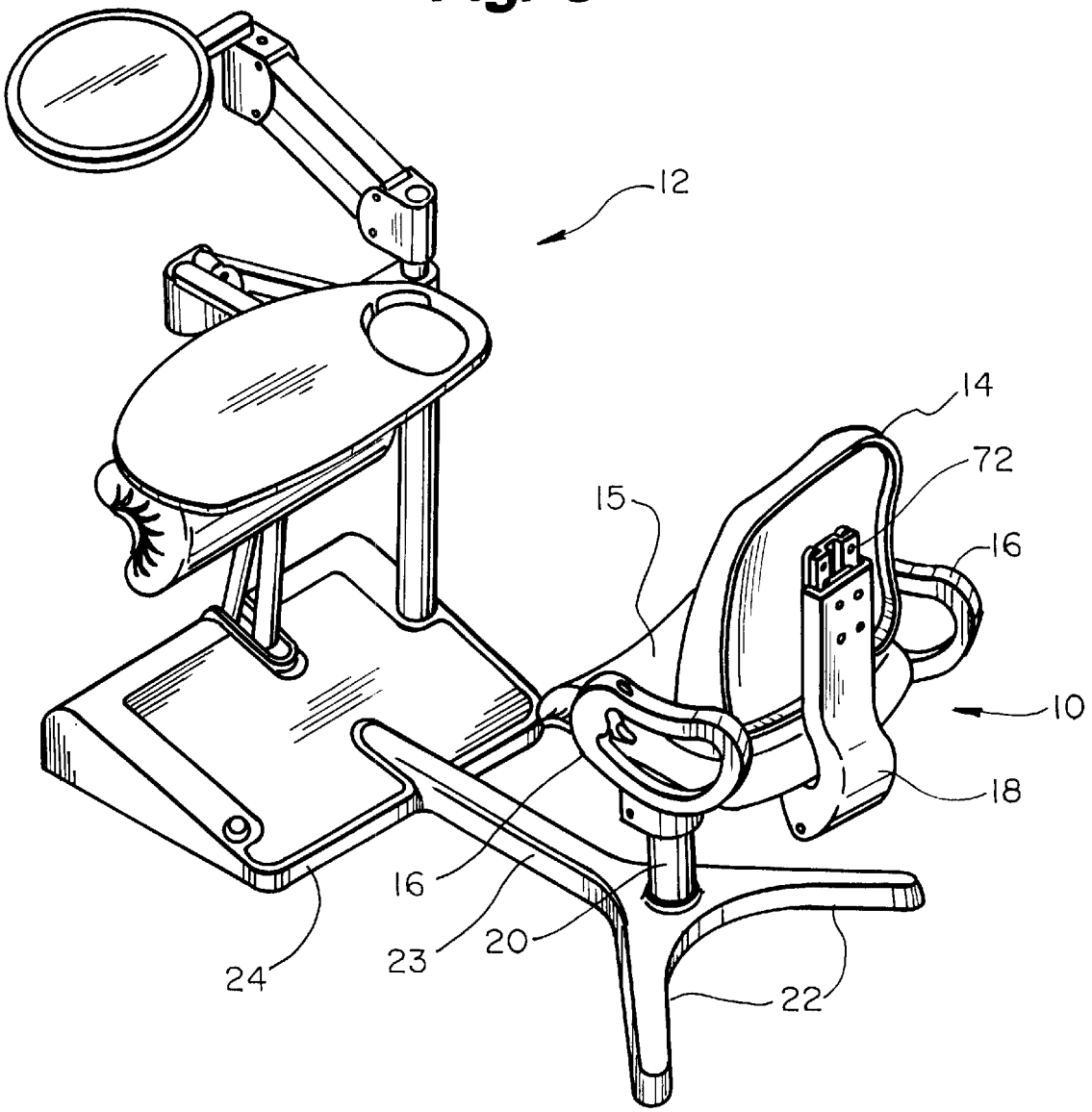
FIG. 3 is an isometric view showing in greater detail adjustable support systems and mechanism.

Directing attention to FIG. 3 now, a detailed section of a manual positioning and locking mechanism for pressure surface 14 is shown. Height adjustment mechanism 72 is a commercially available component such as one manufactured by Milsco or equivalent. Mechanism 72 enables pressure bearing surface 14 to be raised or lowered by the user to various positions along the upper end section of joint 18. The mechanism enables height adjustment of pressure surface 14 to fit the user's specific physiological and lumbar configurations. Particularly, as pressure surfaces 14 and 15 articulate to assume a substantially vertical position, the relative adjustment and positioning of these surfaces become critical in providing proper support as selected parts of the body such as the dorsal, gluteal and lumbosacral regions. In this regard, mechanism 72 is integrated to enable an independent and coordinated adjustment of pressure surface 14.

Figure 4:
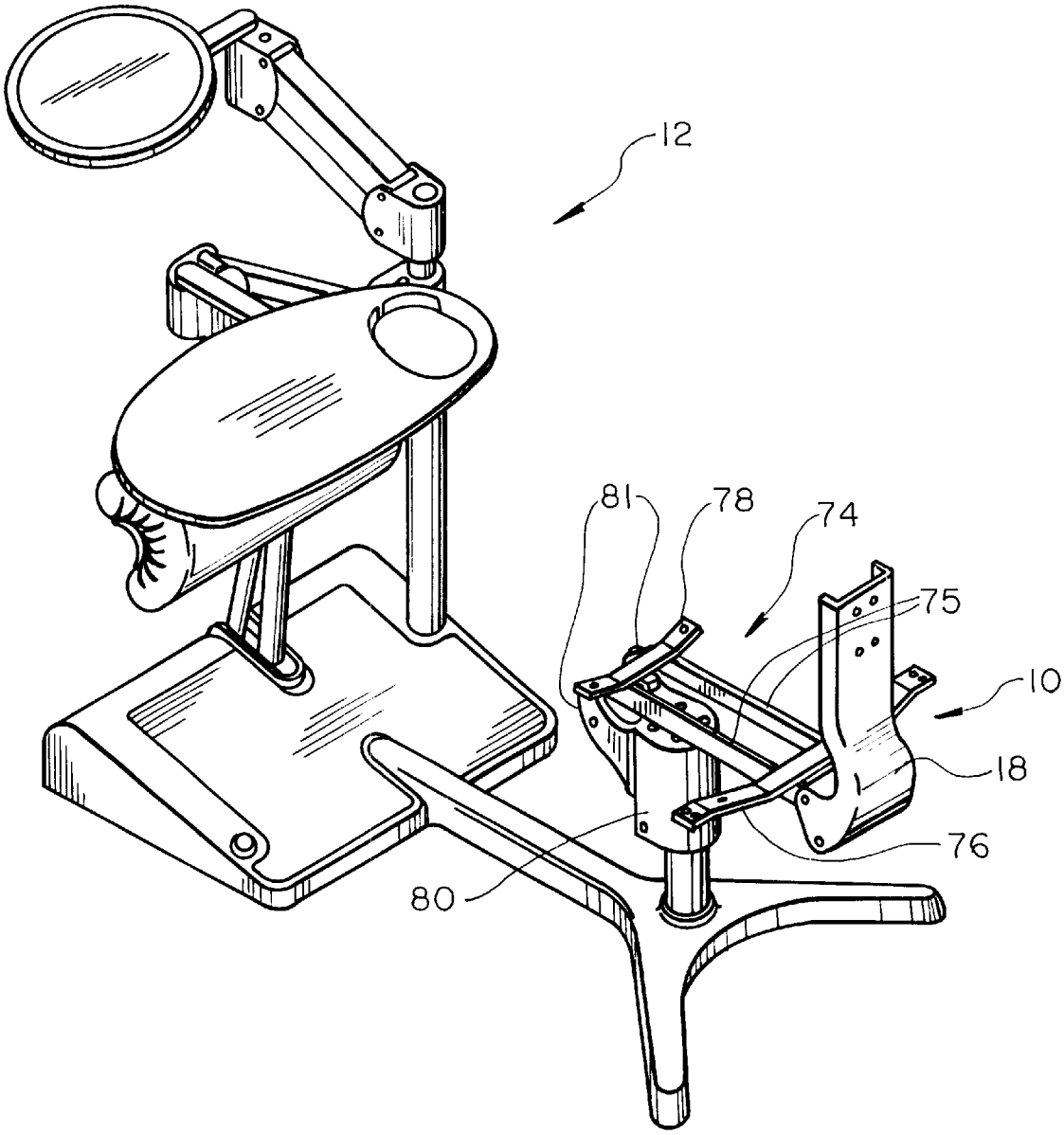
FIG. 4 is an isometric view of the structural details of actuating members of the positioner.

Referring now to FIG. 4, reinforcing structural frame 74 is shown. Structural frame 74 includes a plurality of parallel bars 75 with fore member 76 and aft member 78. Structural frame 74 is secured to aft member 78. Specifically, cap link 80 is rotatably secured to the top end of pedestal 20. Cap link 80 is preferably an extruded substantially hollow cylindrical stub having a first open end and a second closed end. The top end of pedestal 20 is rotatably secured to the open end of cap link 80. At the closed end of cap link 80, a plurality of attachment brackets 81 are distally disposed thereon and provide a hinge connection and support to parallel bars 75.

Figure 5:
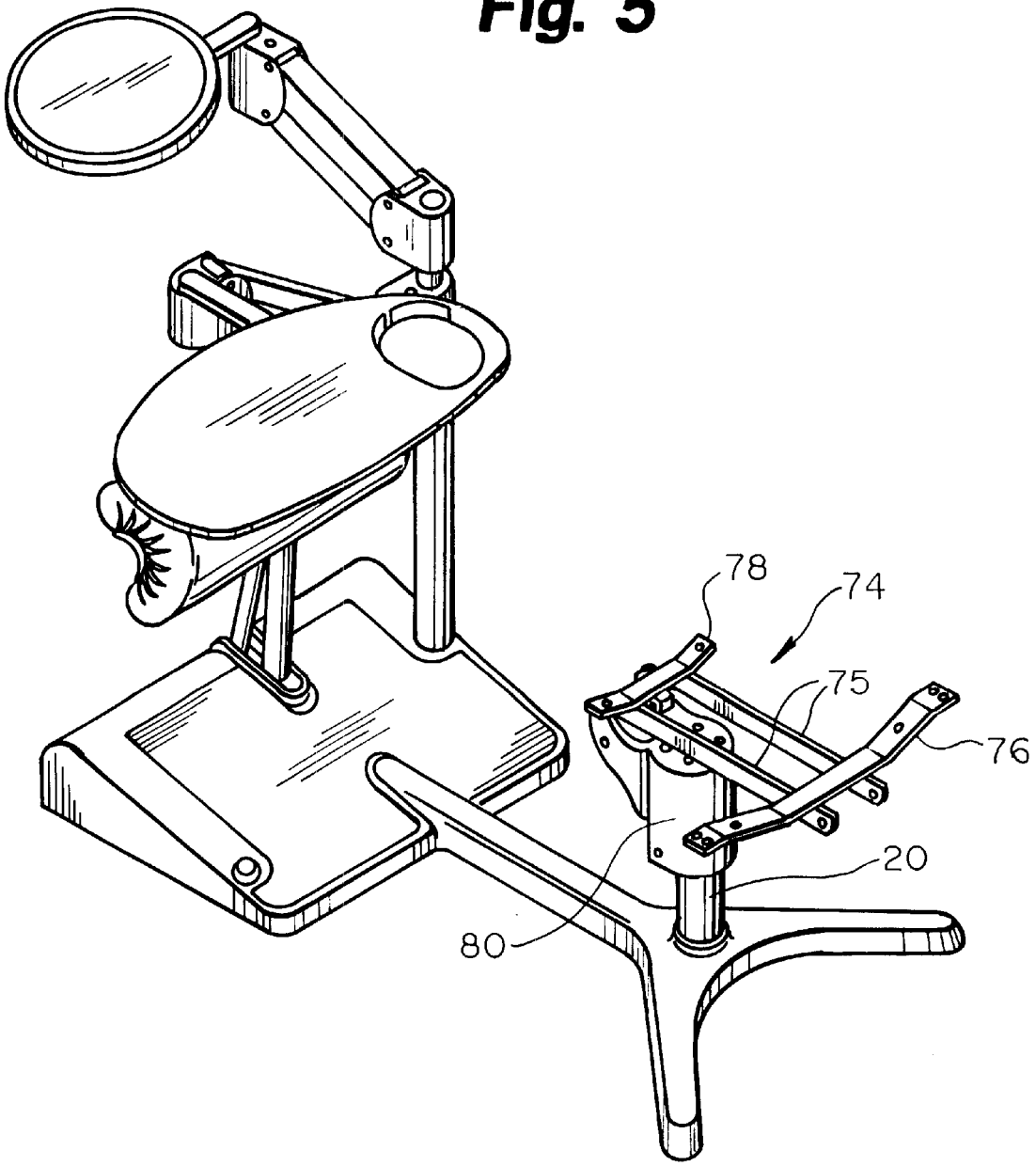
FIG. 5 is a further detailed isometric view of actuating members and cooperative structural links.
Figure 6:
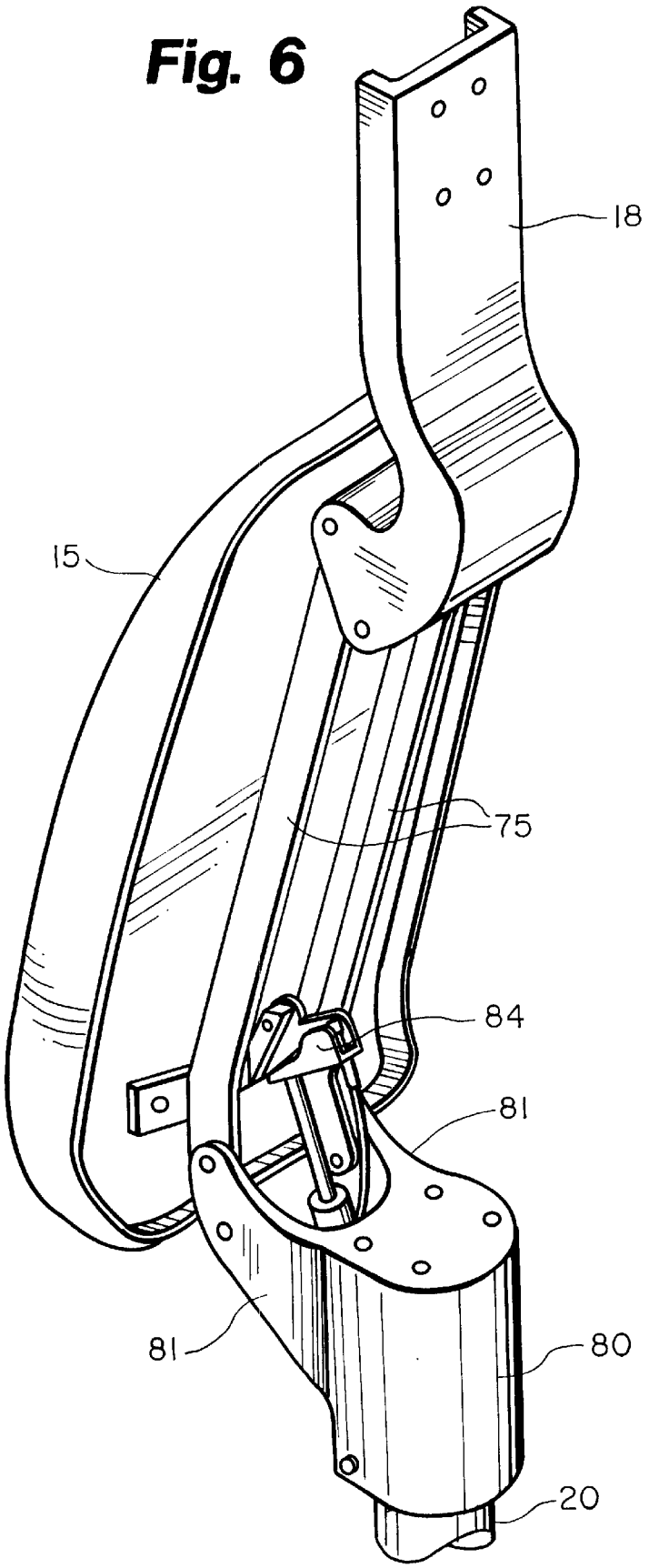
FIG. 6 is an isometric view of position actuation and engagement details and structures for rotating pressure surfaces about a 90° angle.

FIGS. 5 and 6 show in more detail the connection between cap link 80 and structural frame 74. Specifically, FIG. 6 depicts one of the many significant and inventive features of the present invention. Pressure surface 15 and joint 18 are rotated through about a 90° displacement to create a near vertical orientation.thereof. More specifically, whereas prior to rotation, structural frame 74 and joint 18 are substantially perpendicular to each other, after the 90° translation, they are transposed into a substantially co-planar relation. As described hereinbelow, this coordinated and dynamic orientation of structural frame 74 and joint 18 provides various ergonomically desirable positions of pressure surfaces 14 and 15 such that a user is enabled to progressively change postures from sitting to lean/stand positions. The mechanism for the rotation is preferably a position with pneumatic, hydraulic, electric or equivalent drive. For example, air cylinder 82 is shown bearing against fixed block 84. Block 84 is pivotably connected to structural frame 74. Cylinder 82 is linked to block 84 and when the piston is extended, structural frame 74 is rotated to the full extension of the piston. Preferably, structural frame 74 is rotated through 90° to assume a substantially vertical orientation.

Figure 7:
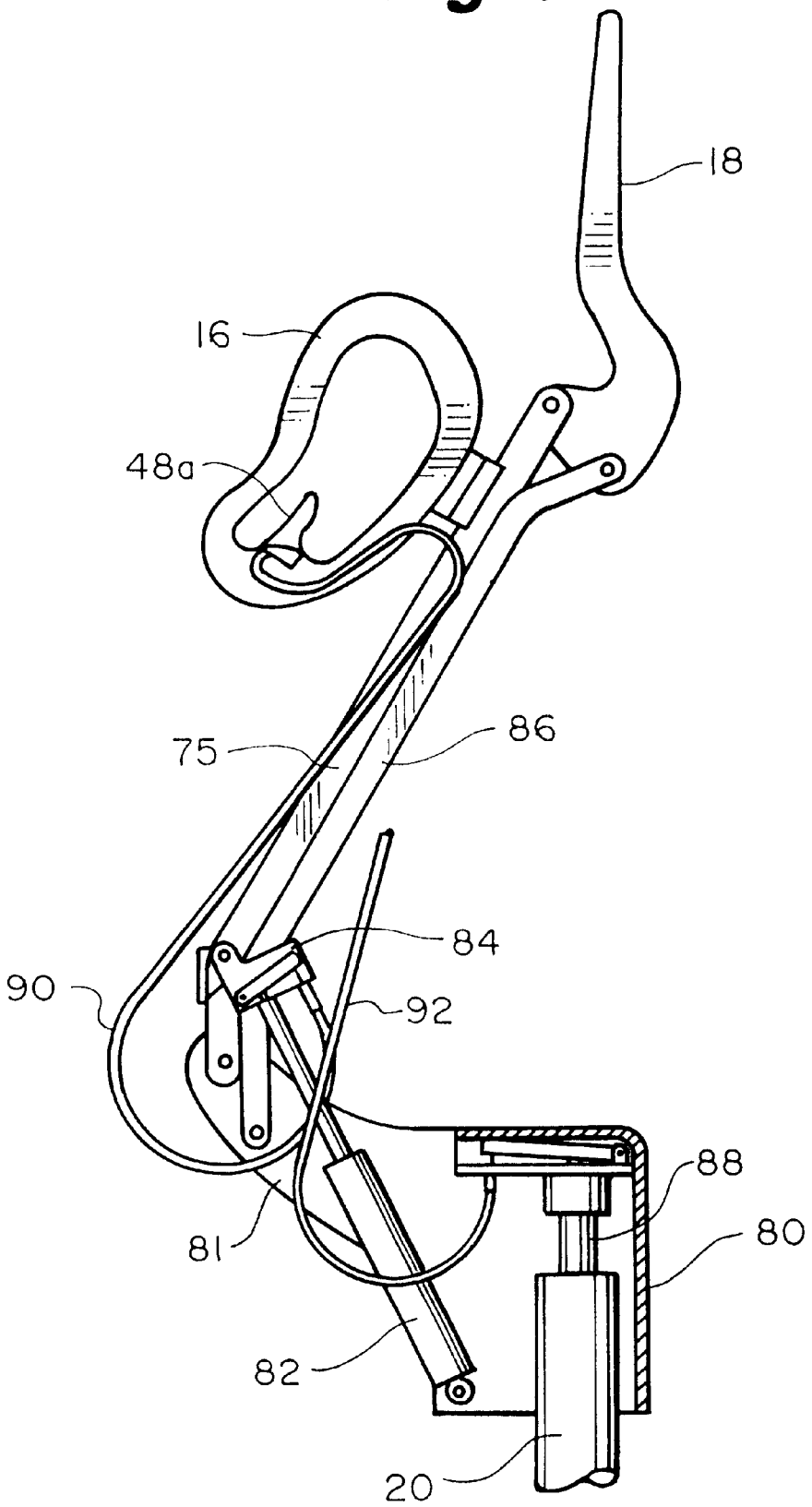
FIG. 7 is an isometric view of the structure and actuation control lines from the triggers which operate the push-pull pistons.

Directing attention to FIG. 7, one of the many significant features of the present invention is shown. Specifically, parallel bars 75 and bar linkage 86 provide an articulating structural linkage which enables to maintain joint 18 perpendicular to the horizontal plane at all times. FIG. 7 shows the near side of 2-bar connection to joint 18. A second set of symmetric 2-bar connection on the far side of joint 18 forms a 4-bar linkage. Each 2-bar linkage is connected to brackets 81. Accordingly, when structural frame 74 translates from a horizontal to a substantially vertical position, joint 18 is elevated through the radius of rotation while maintaining its original vertical orientation relative to stabilizers 22 and connector arm 23. This arrangement enables pressure surface 14 to maintain a vertical orientation at all times. Further, FIG. 7 shows cylinder 88 encased in pedestal 20. Cylinder 88 is implemented to move or adjust structural frame 74 up or down. Both cylinders 82 and 88 are actuated by triggers 48 each embedded under articulating arm 16. For example, right trigger 48 may be used to actuate cylinder 82 and left trigger 48 may be used to activate cylinder 88. Exemplary control line 90 is shown connecting trigger 48 to cylinder 82. Similarly control line 92 is partially shown extending from cylinder 88 to the other trigger 48 (not shown). Each side support 16 is secured to each parallel bar 75. As discussed hereinbelow, side support 16 includes a geometric loop with various features adapted for articulation and enhancement of ergonomic positioning of the user.

Figure 8:
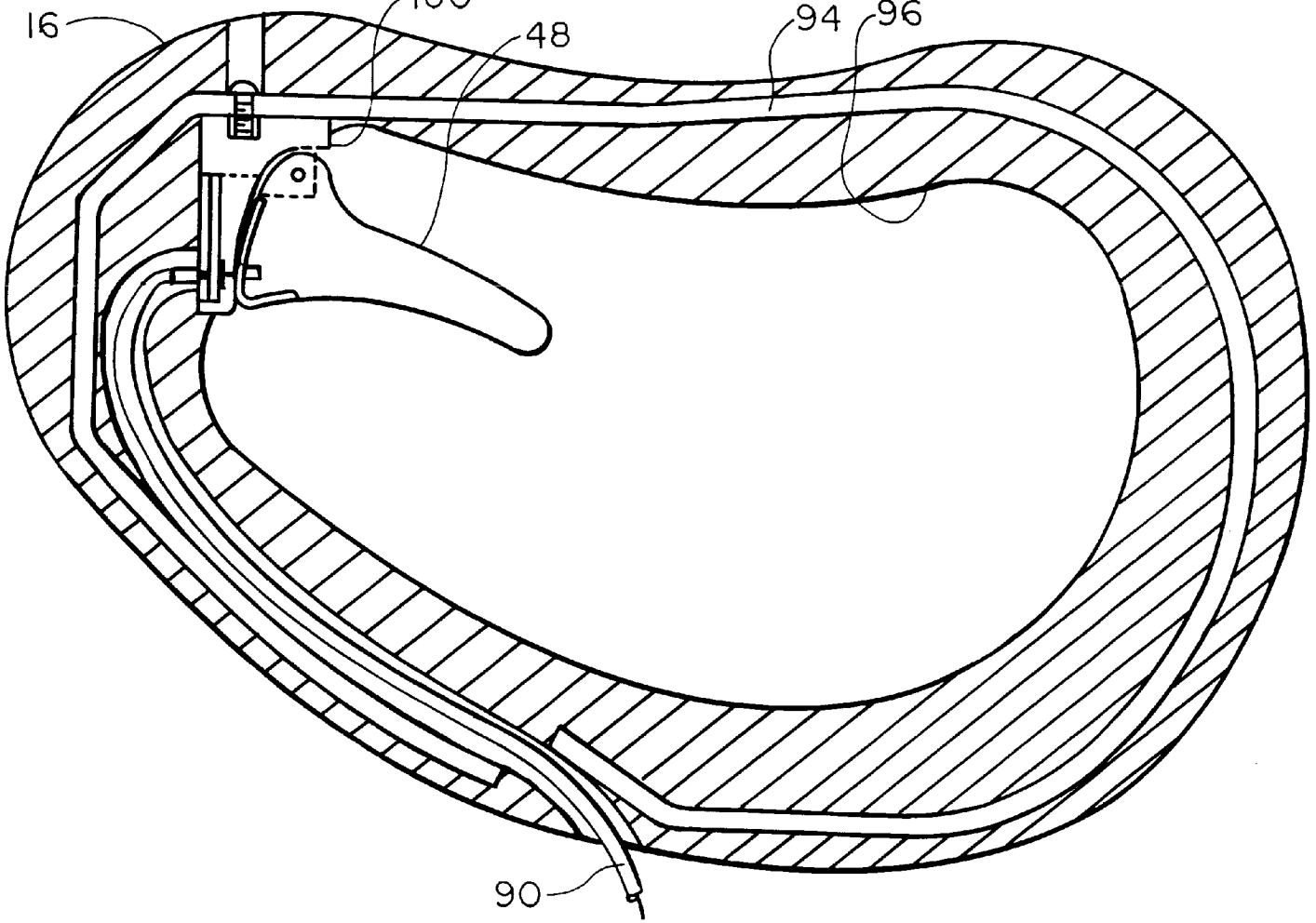
FIG. 8 is a cross-section of the side support loop structure.

FIG. 8 depicts a detailed structure of side support 16 and control line 90 embedded therein. The shape of side support 16 is an ellipsoidal loop with one end narrower than the other and further having one side bulging outward and the opposite side depressed inward. Trigger 48 is secured on the inner surface of the narrower side proximate to the depressed region. Trigger 48 is set to be tactile and is accessible to a person resting the palm of the hand on the top surface of the depressed region. Further, the depressed region promotes sure-grip and control by users especially during the articulation of side support 16 which rotates in conjunction with structural frame 74. Member 94 provides rigidity to the outer elastic member 96. Member 94 may be made of structural grade steel, aluminum or equivalent, whereas member 96 is preferably semi-rigid urethane, rubber, polyvinyl or equivalent. Control line 90 is connected to trigger 48 through an internal cavity 98. Retention bracket 100 is used to pivotally secure trigger 48 such that when trigger 48 is squeezed, control line 90 is activated to thereby actuate cylinder 82 or cylinder 88, depending upon which one of the two triggers 48 is being used. Each of triggers 48 can be activated separately or can be used simultaneously together.

Figure 9:
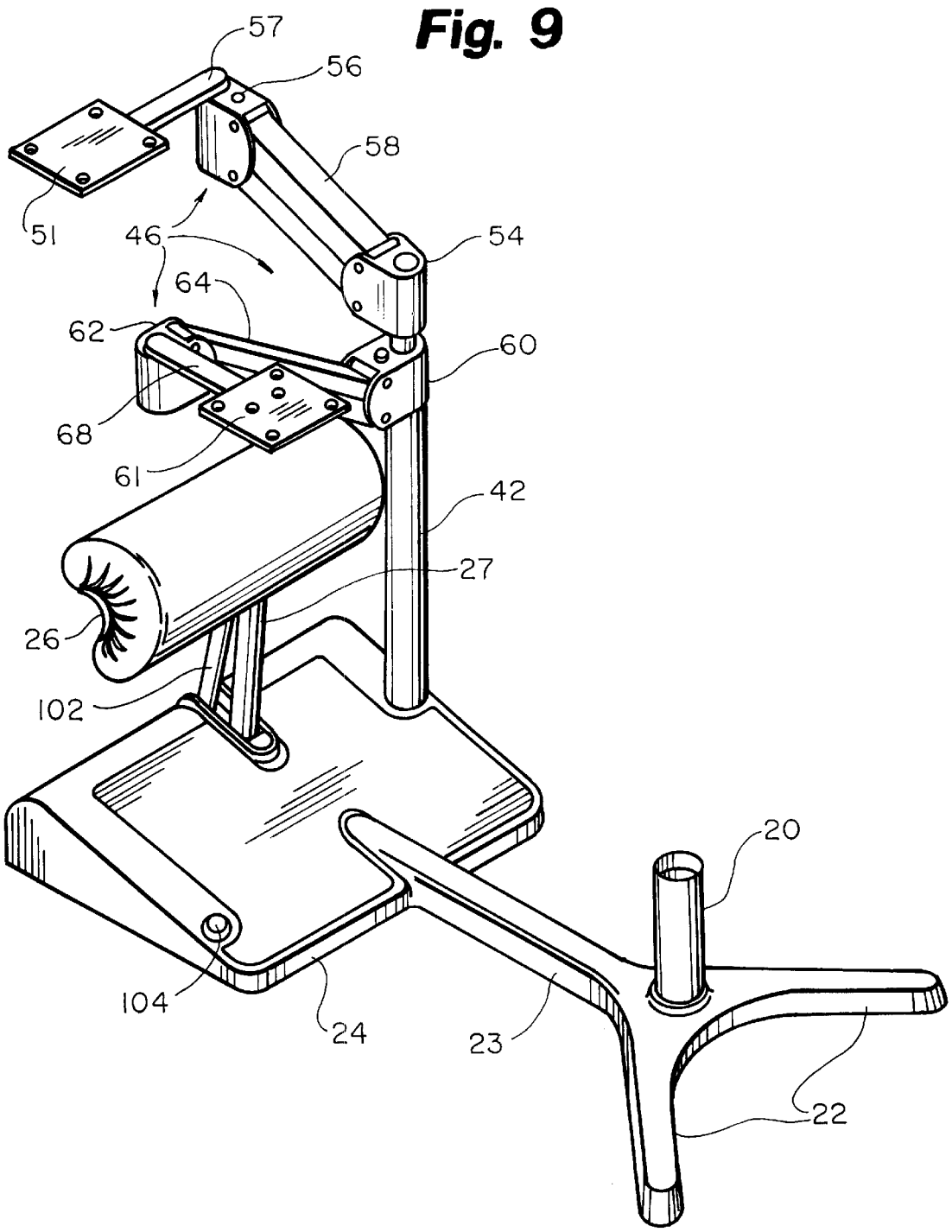
FIG. 9 is an isometric view of the control lock mechanism for the work surfaces such as the monitor and keyboard support including lower body support mechanism in greater detail.

Referring now to FIG. 9, an isometric view of the control mechanism for the work surfaces such as monitor support 36 and keyboard support 38 including lower body support mechanism are shown. Specifically, compound linkage framework 46 includes flex joints 54 and 60 secured on support column 42. The flex joints enable several degrees of freedom/adjustment in the thri-axis primary planes. One of the many unique aspects of the arrangement includes the use of single support column 42 to fixably secure articulating flex joints 46. This arrangement and structure enables space-volume efficiencies and provides an interference free, independent and simultaneous adjustments of support platforms 51 and 61 on which monitor support 36 and keyboard support 38 are mounted, respectively.

Still referring to FIG. 9, lower body support pad 26 including link member 27 are shown mounted on base structure 24. Base structure 24 includes a generally increasing gradient from the near end to the far end. This gradient is preferably about 15°. The gradient enables the user to assume a firm foot grip on the non-skid surface of base structure 24. In an alternative embodiment, the gradient is preferably greater than 15° to provide support for the feet and provide balance in lieu of lower body support pad 26. Lower body support pad 26 is articulated by cylinder 102. Button 104 activates cylinder 102 to rotate and hold in place lower body support pad 26. As will be seen hereinbelow, connector arm 23 is a tension member and serves as a bridge between lower body support structure and articulating pressure surfaces 14 and 15. Further, base structure 24 operates as a counter-weight and center of gravity stabilizer against articulating pressure surfaces 14 and 15, the associated structures therewith, and the weight of the user which generates variable dynamic rotational moments about pedestal 20.

Figure 10:
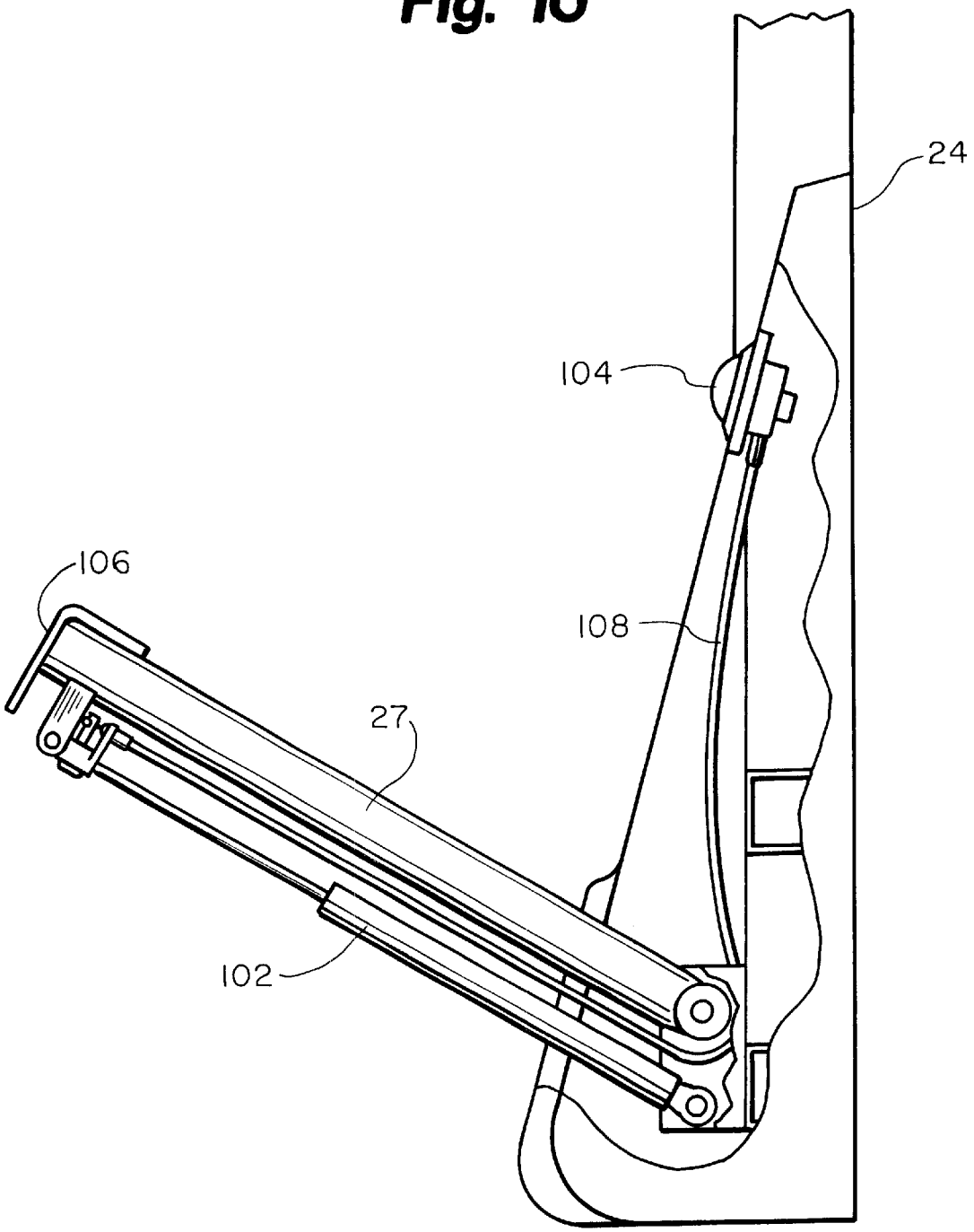
FIG. 10 is an isometric view of the actuating mechanism for the lower body support.

FIG. 10 shows further details of link member 27 and cylinder 102. Button 104 is connected to control line 108 and actuates cylinder 102. Cylinder 102 rotates link member 27 and fixes it at a desired angle. Support pad 26 is secured to reinforcing structural angle 106. Support pad 26 includes resilient outer surfaces having substantially parabolic shapes. Support pad 26 serves various functions. Some of the important bio-mechanical and structural advantages of support pad 26 include its implementation to provide an adjustable fulcrum to the user's body in cooperation with articulating pressure surfaces 14 and 15. Further, pad 26 operates as a body balancer and posture adjustment mechanism. When the user shits from a sitting posture to a lean/stand posture, support pad 26 is implemented to bear some of the shifting weight. In this regard, support pad 26 acts as a body balancer and a point at which the user may shift the center of gravity (combines own center of gravity of the user and positioning system 10 under both dynamic and static conditions) without falling or sliding out of articulating pressure surfaces 14 and 15. Yet another cooperative structural aspect of support pad 26 includes its implementation as a transitional dynamic weight support and stabilizer. The parabolic oblong shape of support pad 26 promotes rotation at the knee and shin regions such that the user is enabled to rotatably transpose from one posture to another by adjusting the pressure and angular orientation of support pad 26 using operating button 104. Support pad 26 may also be implemented as an adjustable leg rest. The user may be positioned in a normal sitting position with the leg stretched out and the posterior aspect of the legs resting on support pad 26.

Figure 11:
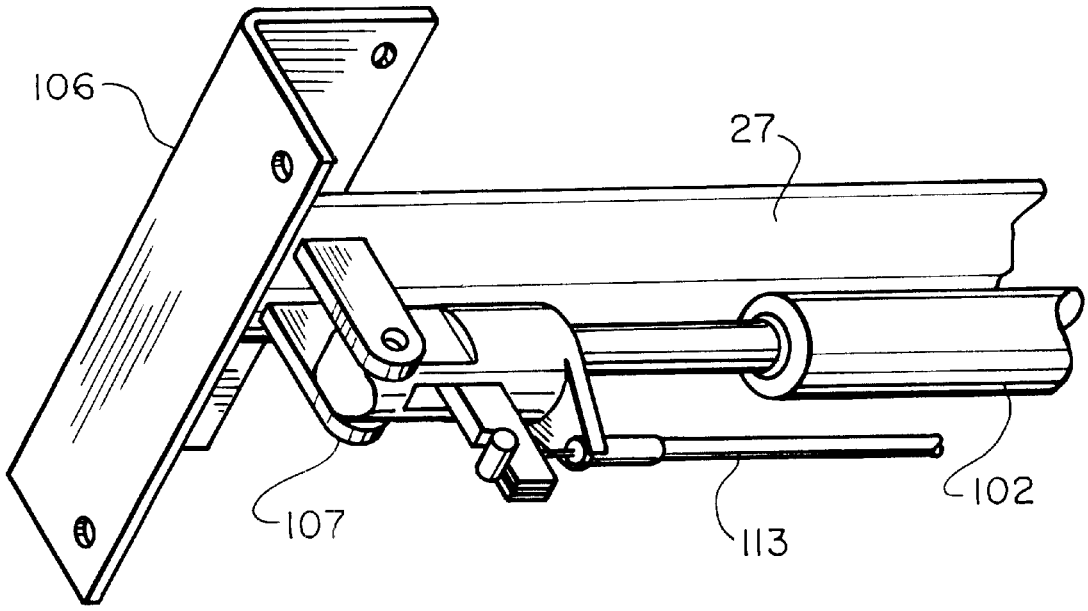
FIG. 11 is an isometric view showing underlying structural connections and organization of a piston and the lower body support.

Referring now to FIG. 11, a detailed view of support pad 26 is shown. Particularly link 107 provides a secure link between cylinder 102, link member 27 and structural angle 106. Link member 27 is rotatable through approximately 75° with about 45° toward the user from the vertical and about 30° away from the user from the vertical. The user presses button 104 to actuate cylinder 102 and applies bodily pressure on support pad 26 to adjust it away from the knees/legs. In the alternate, button 104 is pressed to allow support pad 26 to rotate towards the user. In either case, releasing button 104 locks support pad 26 into position.

Figure 12:
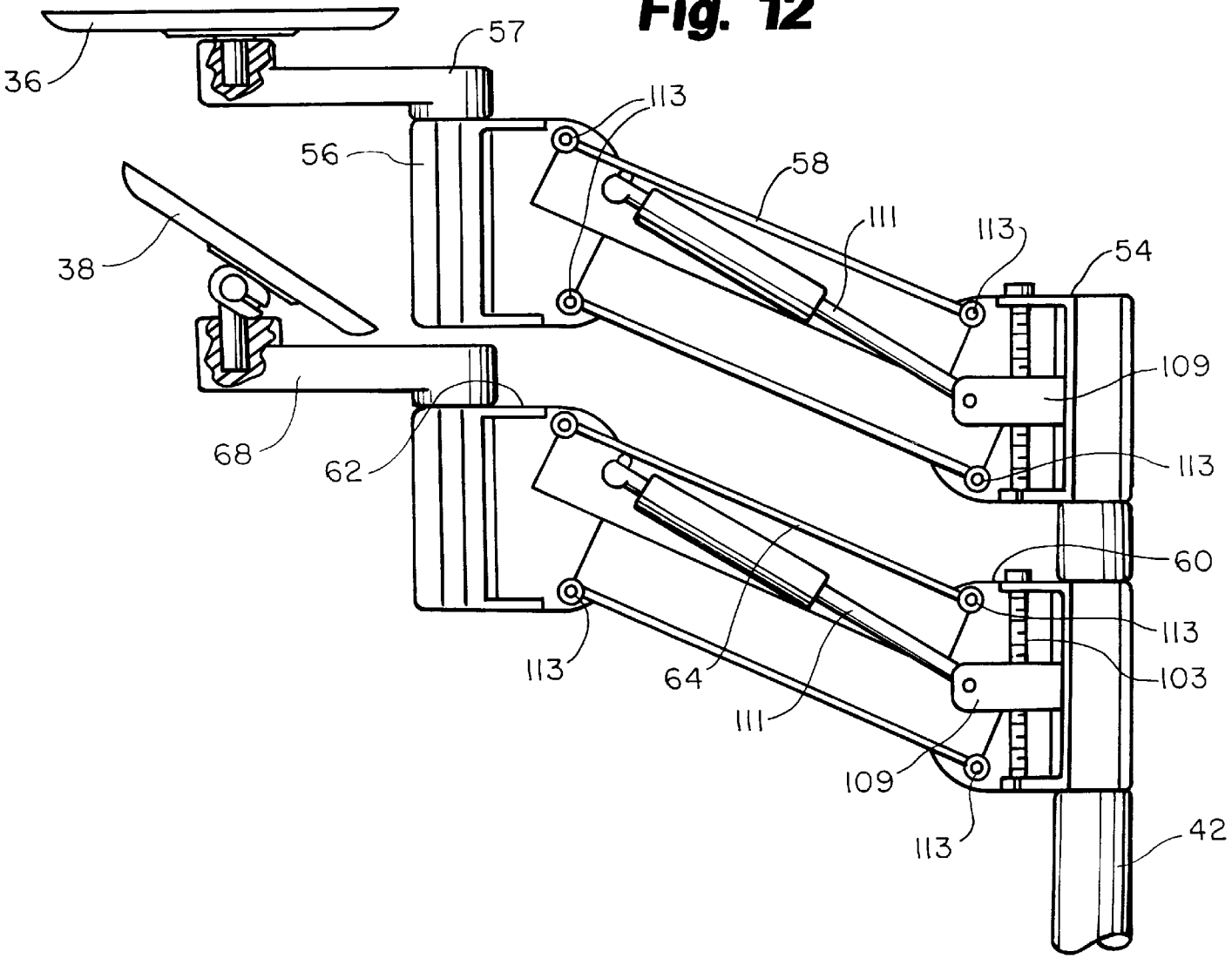
FIG. 12 is an isometric view of the rotational position control/lock mechanism for adjusting the work tool support surfaces and connections thereof.

FIG. 12 shows the rotation, articulation, and positioning in single or combination of three-dimensional planes of platforms 36 and 38, including the compound linkage comprising intermediate member 58 and 64 preferably formed of bar linkages. Specifically, column 42 supports a plurality of work stations preferably cantilevered therefrom. More specifically, the use of single column 42 enables the stacking of various work stations without the complication of interference and crowding which may result due to multiple supports and columns. Flex joints 54, 56, 60, and 62 enable articulation and rotation in three dimensions. Specifically, joints 54 and 60 coupled with threaded screw 103 enable universal adaptability for adjustment in three-dimensions. Screw 103 is adjusted by link member 109 indexing up or down. This movement results in changes of the leverage of gas spring 111 and thereby enables adjustment for varying weights. For example, when the load to be supported at platform 36 or 38 is heavy, link member 109 is indexed downward to shorten the extension of intermediate members 58 and 64, thereby reducing the length of the cantilever and increasing the capacity to carry a heavy load. Alternately, when link member 109 is indexed upwards, joints 58 and 64 extend outward, thus reducing the capacity to carry a cantilevered load at platforms 36 and 38, as well as extending the reach of the assembly orthogonally from column 42. The flexibility and adjustability of each of the structural components, individually and in combination, enables the assembly of FIG. 12 to be most versatile for support in work tools and highly synergistic with positioning system 10. Flex joints 54 and 56 enable full 360° rotation at column 42. Further, flex joints 56 and 62 provide a coupling for a full 360° rotation of joints 57 and 68, respectively. Additionally, pivots 113 cooperate with bar linkage of intermediate members 58 and 64 to be responsive to the changes in leverage of gas spring 11. Yet another feature of the invention includes the rotatability of platform 36 and the rotatability and tiltability of platform 38. Platform 36 is structured to support a computer screen or similar work tools. Platform 38 is well suited to carry a keyboard or similar work tools which may need to be adjusted in several orientations. One of the many unique aspects of the structure includes its lockability in any position after adjustment. Specifically, the user is enabled to configure the position of the work tools to be compliant and ergonomically congruent with positioning system 10. More specifically, the user applied minimum manual pressure to adjust the position of support platform 36 or 38 as needed. Platforms 36 and 38 remain locked in position after adjustments have been made. Thus, the tool support platform structure of the present invention provides several degrees of freedom to orient the work tools, and is designed to be synergistic with positioning system 10 by allowing quick dynamic adjustments relative to a desired postural configuration.

Figure 13:
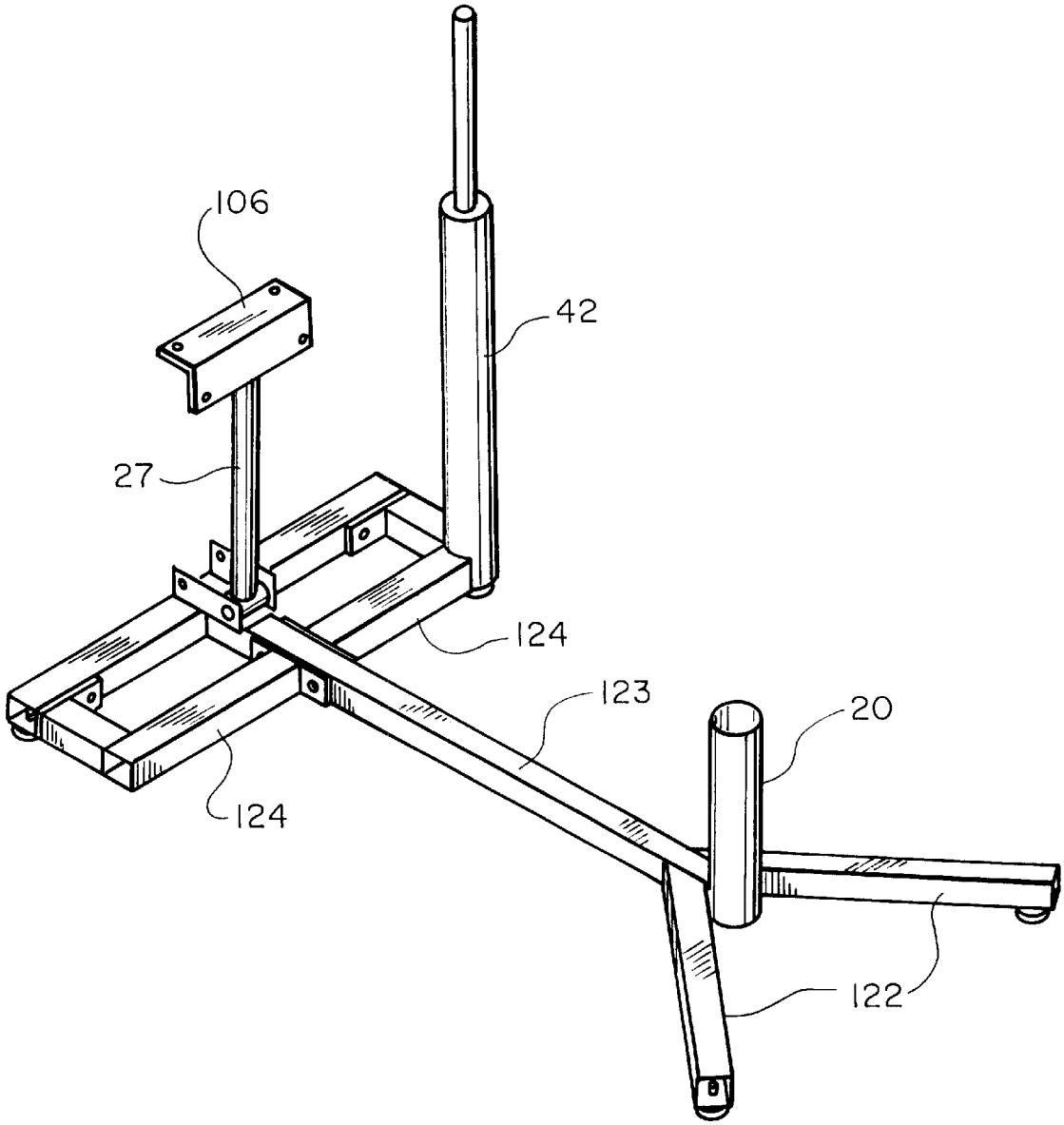
FIG. 13 is an isometric view of the main structural base and support assembly.

Referring now to FIG. 13, the underlying structural assembly of positioning system 10 is shown. Preferably, the material of construction is structural grade steel, aluminum or equivalent. The frame work includes fore and aft assemblies connected by member 123. Fore assembly comprises members 122 which are preferably welded to member 123 and extend in symmetrical angular relations therefrom. The aft assembly includes rectangular structures 124 and 126 secured to member 123.

Figure 14:
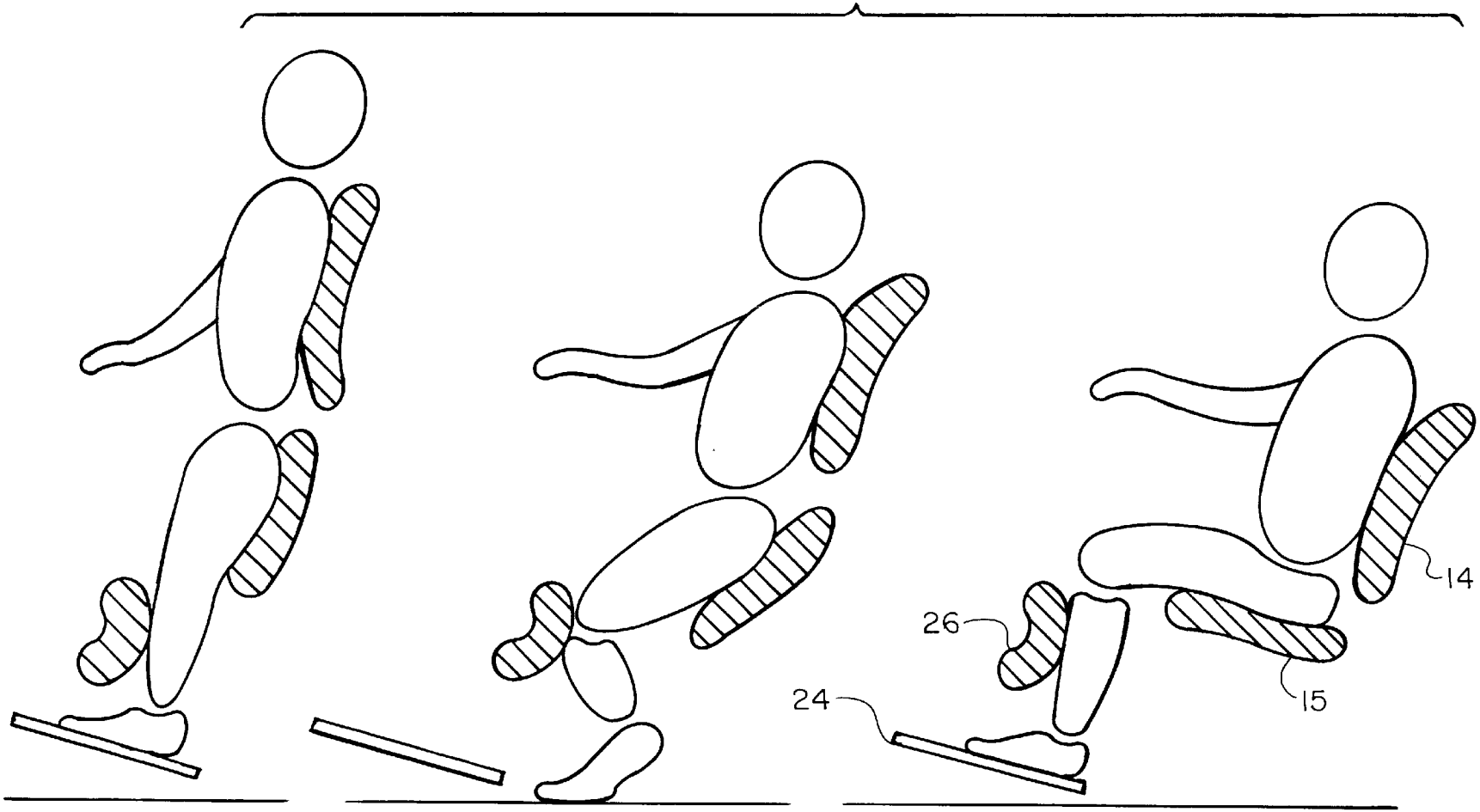
FIG. 14 is a simulation view of the multi-posture range of the present invention.

FIG. 14 is a representation of the ergonomic multi-posture range of the present invention. In the seated position, the user preferably engages pressure surfaces 14 and 15 and support pad 26. The user then activates trigger 48 and button 104 to shift to a breath-easy position. As pressure surfaces 14 and 15 rotate, the angle between the torso and the lower part of the body increases and support pad 26 is actuated forward and rotated to prevent the user from sliding off pressure surface 15. As the user continues to rotate with pressure surfaces 14 and 15, it is preferable to adjust the position of support pad 26 and lock it in place so that the user can negotiably maintain contact with pressure bearing surfaces 14 and 15 and keep the body in balance.

Figure 15:
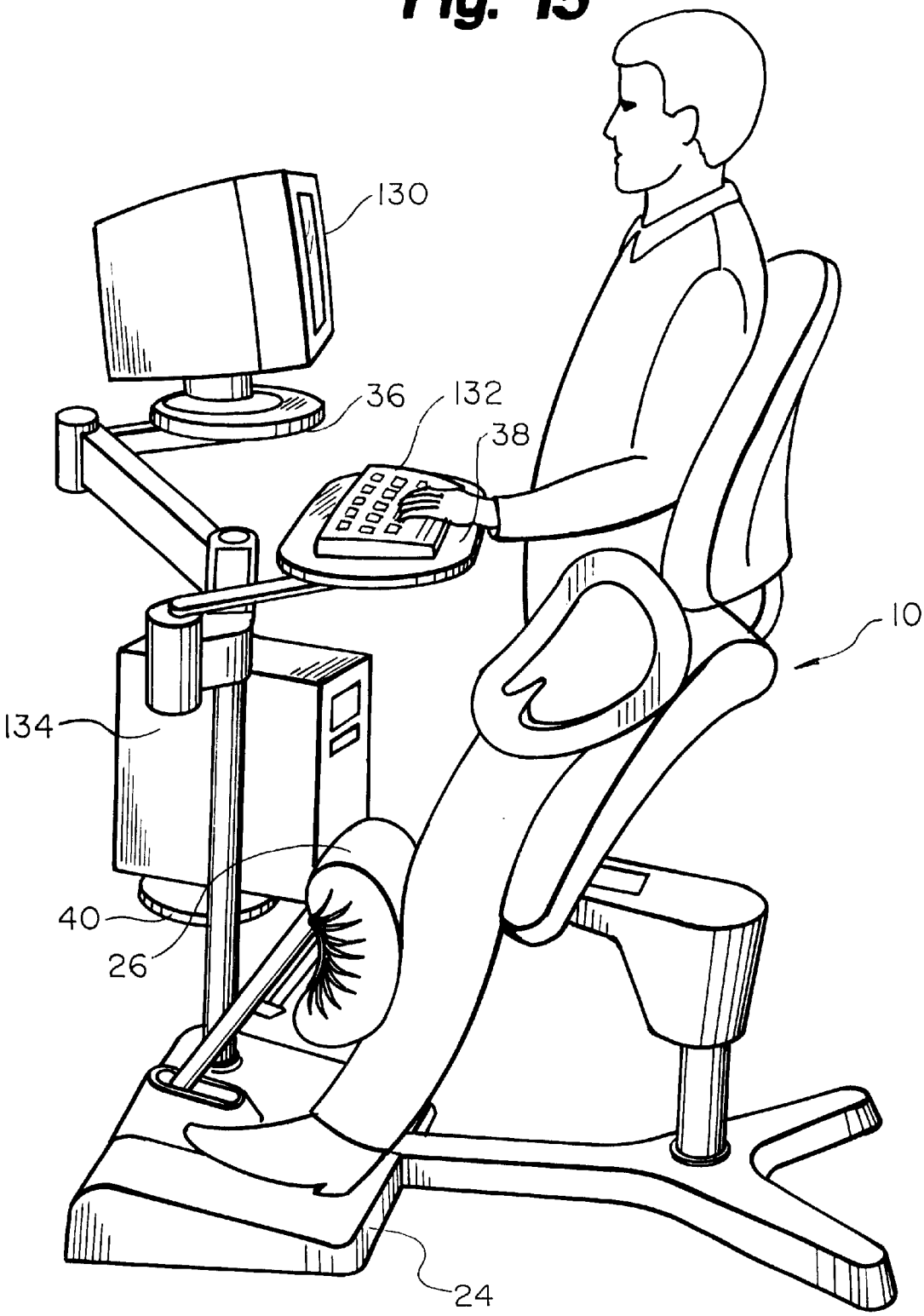
FIG. 15 is an isometric view of the present invention integrated with a computer console/station.

FIG. 15 is a representative depiction of positioning system 10 integrated with computer work station 12. Monitor or screen 130 is placed within the visual and ergonomic ranges of the operator. Keyboard 132 is set for easy access to the hands and CPU 134 is placed within the ergonomic range of the operator while clearing any possible interference with positioning system 10, especially during articulation, thus allowing timely postural adjustments by the user.

Figure 16:
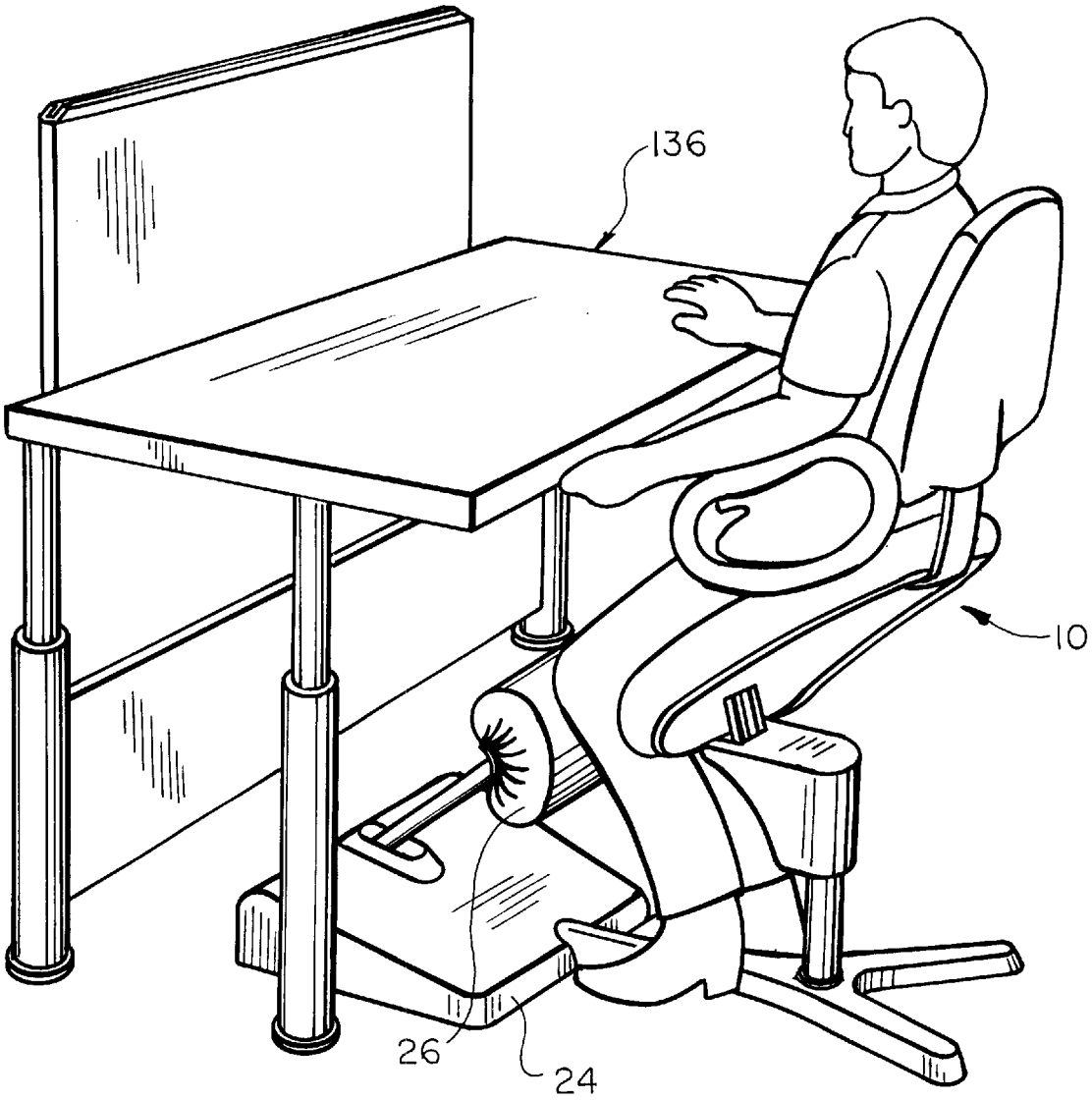
FIG. 16 is an isometric view of the positioner being used in non-integrated set up in an assembly type environment.

FIG. 16 is another embodiment of the present invention. Positioning system 10 is shown with work station 136 not attached or integrated with positioning system 10. In order to ensure stability and safety, base structure 24 is filled with stabilizing weights such as water, sand or equivalent. The embodiment shows a typical work station 136, such as an assembly line, in which a task is performed in a substantially sitting position. The implementation of positioning system 10 advantageously enables the worker to shift through various ergonomic postures without interrupting the task at hand. As discussed hereinabove, the present invention enables the worker to benefit from active sitting through timely movements of the muscles and the body, and from proactive positioning which forms the body into clinically advantageous postures. Specifically, three basic adjustment actuators which include (two) triggers 48 and button 104 are used to easily transform the user from a sitting to lean/stand posture.

Figure 17:
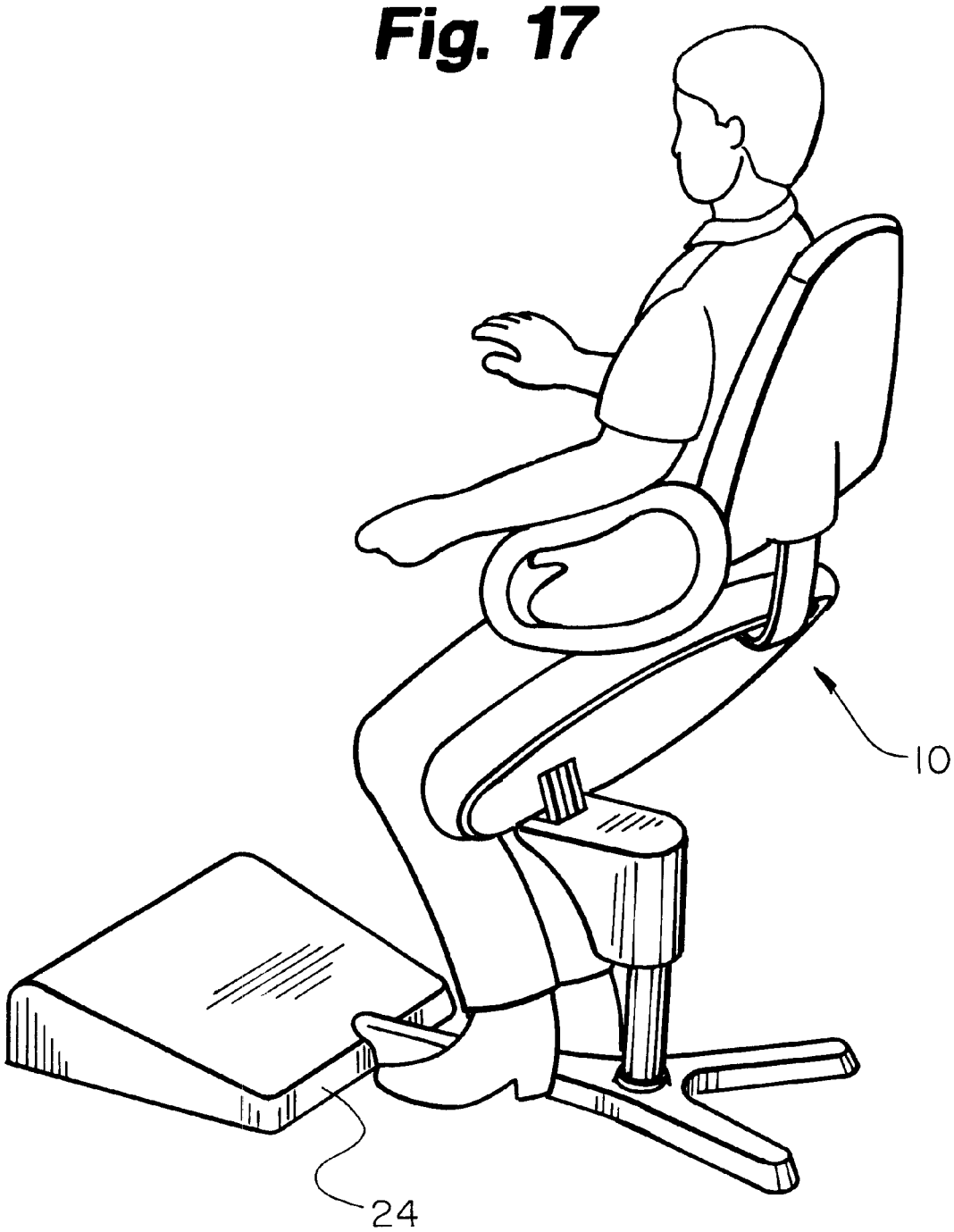
FIG. 17 is an isometric view of an alternate embodiment of the positioner with the knee support structure and pad removed.

FIG. 17 is yet another embodiment of the present invention. Positioning system 10 is shown without support pad 26. In this embodiment, base structure 24 includes a gradient of about 25° or higher to enable balance and support of the user's weight. This embodiment is alternately advantageous in operations where support pad 26 may interfere with the work station or may be undesirable for other reasons. The omission of support pad 26 is compensated for by the increased inclination/gradient of base structure 24.

Figure 18:
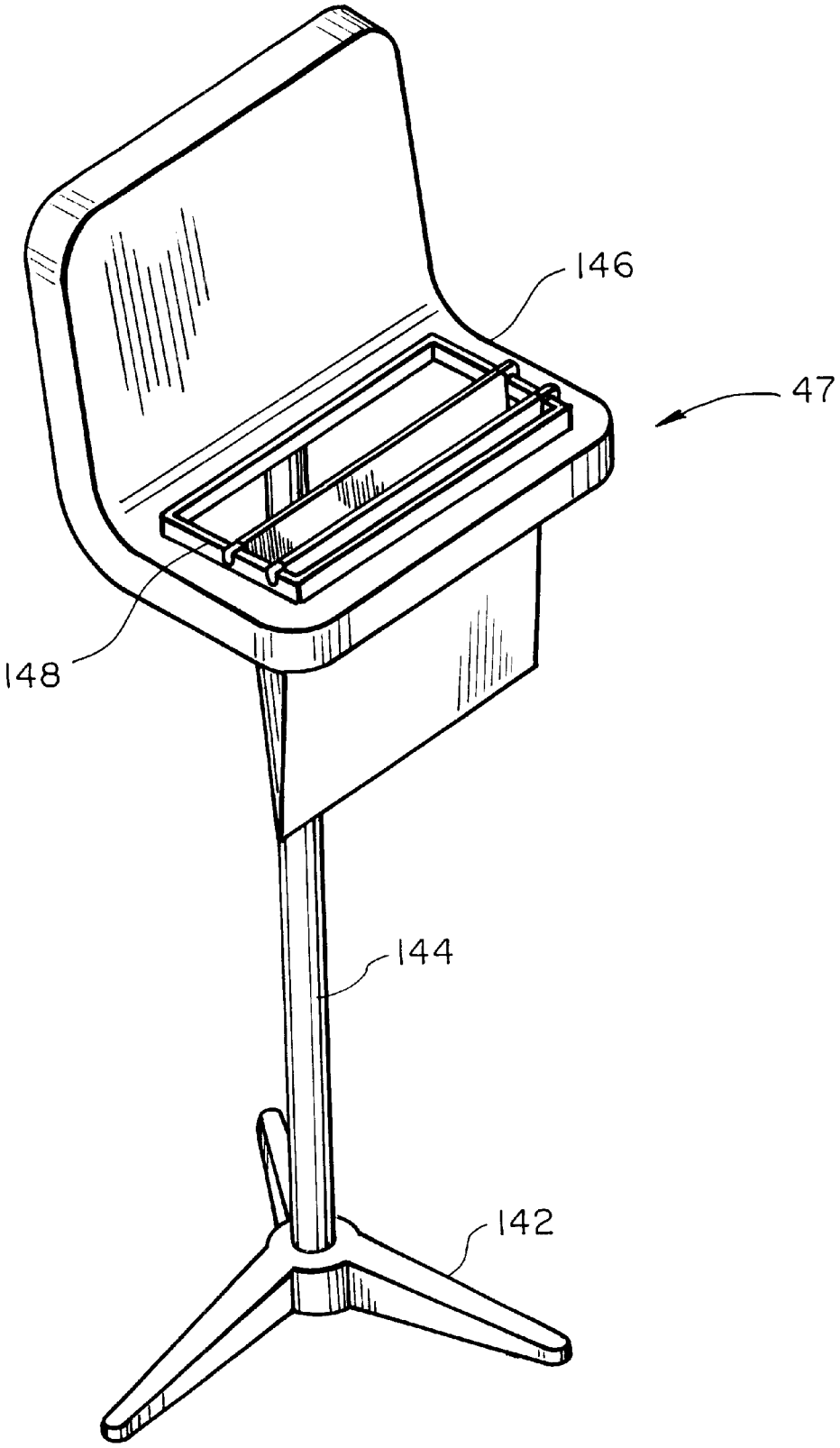
FIG. 18 is an isometric view showing detailed structural parts of the file holder.

FIG. 18 shows a reference holder/working file display 47. Holder 47 includes support base 142 with telescoping column 144 supported at one end thereon. The other end of telescoping column 144 supports a substantially L-shaped structure 146 which includes a mortised section at the leg having edge structure 148 about the perimeter of the cutout. Files and folders are suspended through the cutout and supported on edge structure 148.

Figure 19:
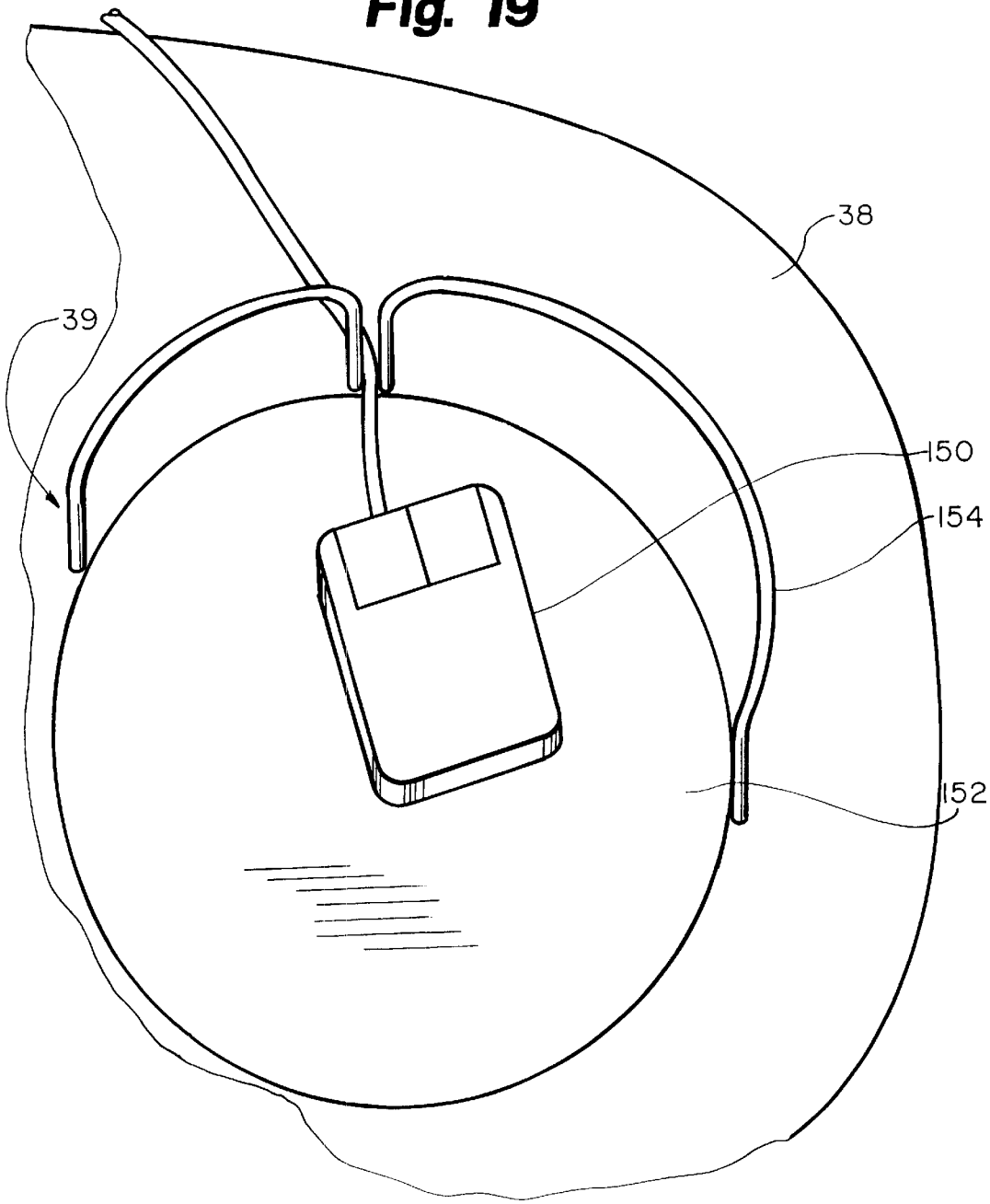
FIG. 19 is a detailed isometric view of the mouse cage.

Directing attention to FIG. 19, a detail of the mouse cage structure 39 is shown. Specifically, mouse 150 is supported on pad 152. Retaining structure 154 forms a partial fence to secure mouse 150 in place. This is particularly important when platform 39 rotates/tilts away from the user to provide an ergonomically beneficial positioning of the user in the lean/stand posture. Mouse cage 198 allows mouse 150 to be accessible and available regardless of the tilt angle of platform 38.

Figure 20:
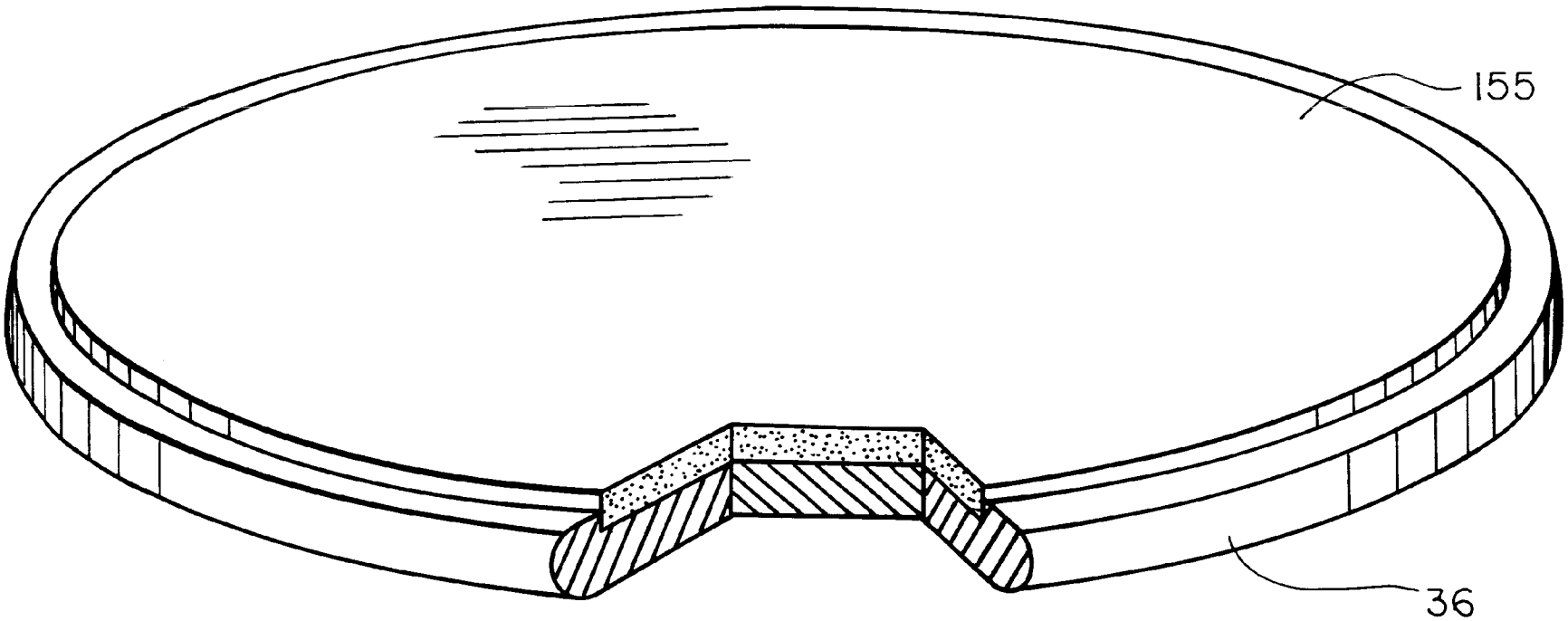
FIG. 20 is a detailed isometric view of the monitor platform with vibration dampener.
Figure 21:
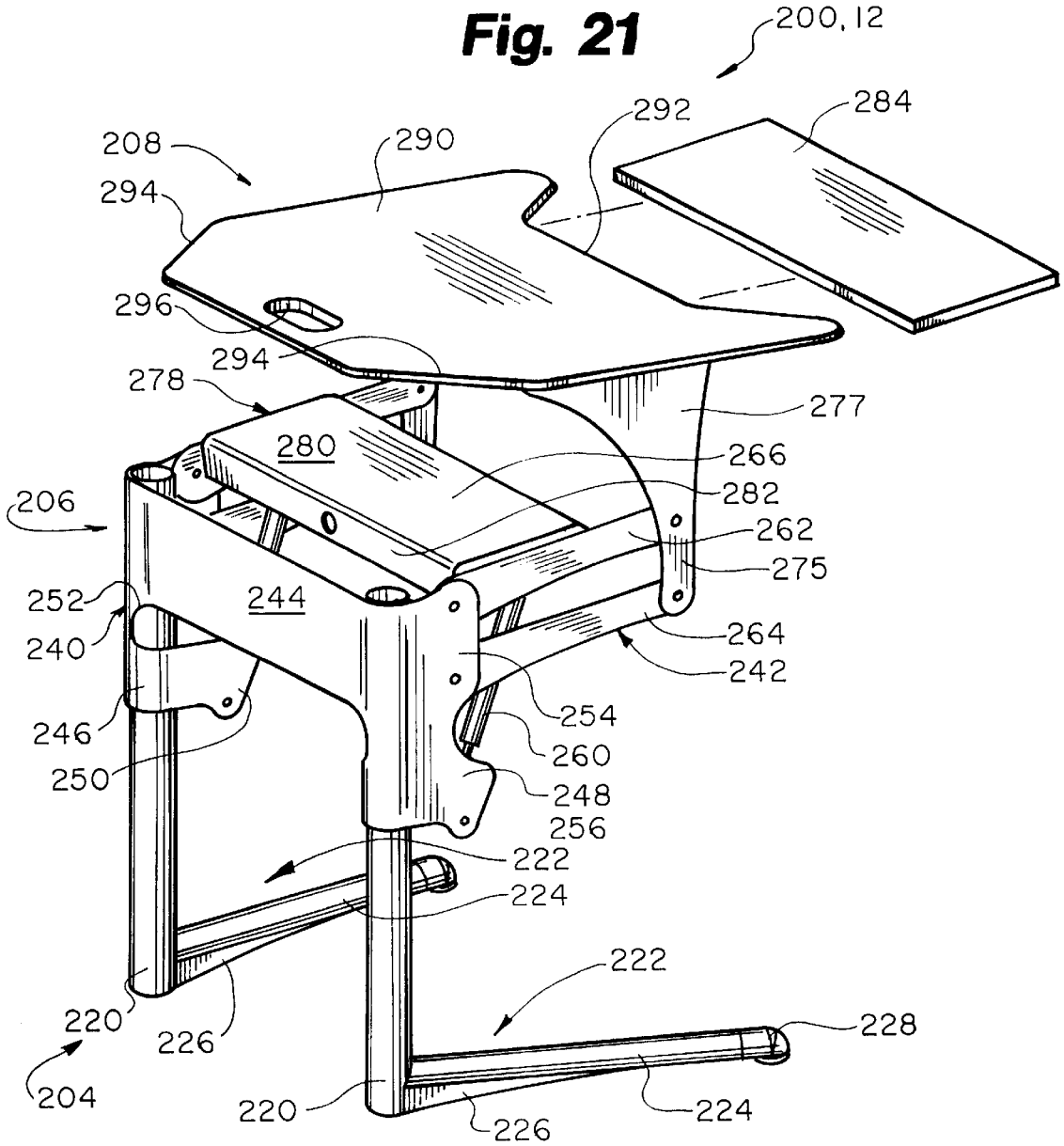
FIG. 21 is a front perspective view of an alternative embodiment of a work station of the present invention.
Figure 22:
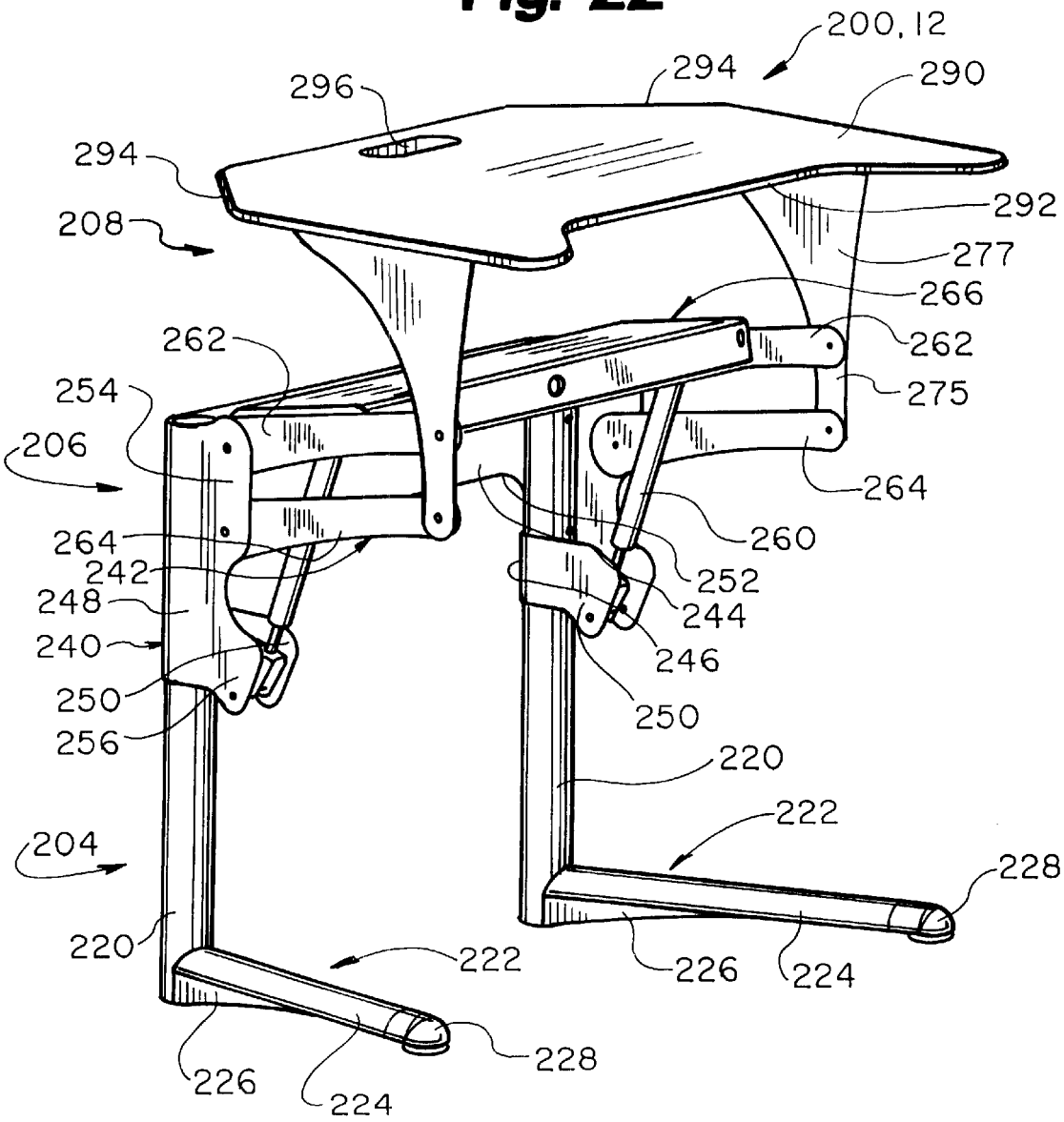
FIG. 22 is a rear perspective view of the alternative embodiment of the work station of FIG. 21.
Figure 23:
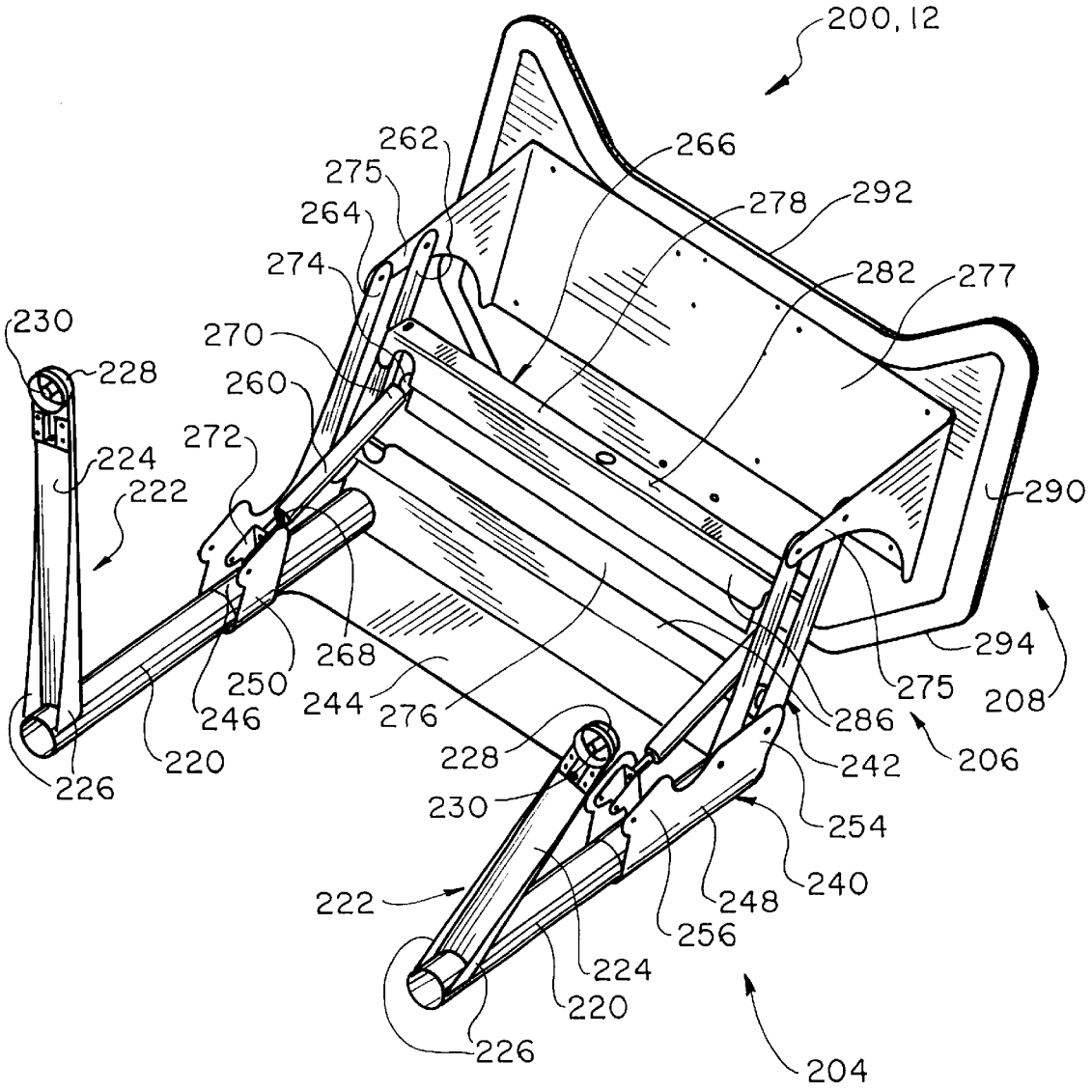
FIG. 23 is a perspective view depicting the underside of the alternative embodiment of the work station of FIG. 21.

FIG. 20 is a detailed drawing showing vibration dampener 155 secured on top of platform 36. Vibration dampener 155 may be constructed from 4# EVA black foam or equivalent. Dampener 155 advantageously reduces/eliminates the transfer of vibration and undulatory movement from the joints and links.

Accordingly, the present invention utilizes structures which cooperate with a user's body to form a dynamic bio-mechanical system to promote active sitting and proactive positioning within a range of clinically preferred healthy human postures. Positioning system 10 is typically integrated with work station 12 although, as is shown in exemplary embodiment of FIG. 16, it can be independently used at various seated task operations. Similarly, some components of the present invention may be omitted to adapt to specialized applications. Further, various components may be modified to adapt to specific work environments.

An alternative embodiment 200 of a work station 12 of the present invention is depicted in FIGS. 21–24. As shown, embodiment 200 of work station 12 generally comprises a support assembly 204, a lift assembly 206, and a work surface assembly 208.

Support assembly 204 preferably comprises a pair of support legs 220, which are preferably of a tubular configuration. Each support leg 220 is unitarily and/or fixedly secured to a stabilizing support 222. Each stabilizing support 222 includes an elongate top portion 224 that is preferably semi-circular in configuration and a pair of side walls 226 that extend substantially perpendicularly down from each side of top portion 224. Side walls 226 are preferably triangular in shape, the triangular shape adding structural rigidity to top portion 224, having the base of the triangle secured to leg support 220 and the tip of the triangle reaching approximately half the length of top portion 224. Each stabilizing support 222 further includes a rounded nose section 228 that preferably houses a height adjustment device 230. Height adjustment device 230 preferably comprises a foot whose height may be mechanically adjusted, e.g., a threaded connection to adjust height, spring-adjusted height, hole and locking pin adjusted height, etc. Alternatively, nose section 228 may house a caster, preferably lockable in nature, allowing for easy positioning of work station 12.

Lift assembly 206 generally comprises a support assembly 240 and a pivoting assembly 242. Support assembly 240 preferably includes a back portion 244, a wrap-around portion 246, an exterior side portion 248, and an interior side portion 250. Back portion 244 extends laterally from first leg support 220 to second leg support 220 and is preferably secured thereto. Further, back portion 244 is preferably unitary with wrap around portion 246; the connection point of back portion 244 to wrap-around portion 246 indicated by arc 252. Wrap-around portion 246 preferably wraps the circumference of each leg support 220 and, as such, is slidably positioned over each leg portion during assembly of work station 12. Once positioned, wrap-around portion 246 is preferably secured in place. Exterior side portion 248 is substantially equivalent in height to the combined height of back portion 244 and wrap-around portion 246, and is preferably secured tangentially thereto at the exterior. Exterior side portion 248 is defined by an upper side portion 254 and a lower side portion 256. Lower side portion 256 is substantially equivalent in shape and in placement along leg support 220, as interior side portion 250. Interior side portion 250 is substantially equivalent in height to wrap-around portion 246 and is preferably secured tangentially thereto at the interior.

Pivoting assembly 242 of lift assembly 206 includes a pair of lift cylinders 260, a pair of main lift arms 262, a pair of follower arms 264, and a slide adjustment assembly 266. Each lift cylinder 260 is defined by a first end 268 and a second end 270. First end 268 is maintained in a fixed position via a bracket 272 that is positioned between lower side portion 256 of exterior side portion 248 and interior side portion 250, and that is secured to interior side portion 250. Second end 270 is maintained in a fixed position by virtue of a bracket 274 secured to the underside of a support bar 276, which forms a part of slide adjustment assembly 266. Main lift arms 262 are pivotally secured between upper side portion 254 of exterior side portion 248 and legs 275 of a table support bracket 277. Each follower arm 264 is positioned below a respective main lift arm 262 and is substantially parallel thereto. Like each main lift arm 262, each follower arm 264 is preferably pivotally secured between upper side portion 254 of exterior side portion 248 and legs 275 of table support bracket 277.

Slide adjustment assembly 266 includes support bar 276, which is fixedly secured to second end 270 of lift cylinder 260, and a slide wrap 278. As indicated above, support bar 276 is preferably fixedly secured to second end 270 of lift cylinder 260 and is additionally preferably secured at its sides to each main lift arm 262. Slide wrap 278, to which may be attached an additional table surface 284 (shown in FIG. 21), is preferably unitary in configuration including a top portion 280, a pair of side portions 282, and a pair of bottom portions 286. Bottom portions 286 wrap to the underside of support bar 276 and include recesses 288 to accommodate the position of lift cylinders 260 allowing slide wrap 278 to be slid back and forth atop support bar 276. Table surface 284 may be fixedly secured or alternatively, pivotally secured to slide wrap 278 to provide for angular adjustment, i.e., tilting of table surface 284.

Work surface assembly 208 generally includes a rigid work surface 290 and table support bracket 277. Work surface 290 may be of any desirable shape but preferably includes a recessed portion 292 allowing work surface 290 to surround a user and angled corner portions 294. Work surface is preferably provided with an aperture 296, which may be used as a handle to aid in lifting and lowering work surface 290 in conjunction with lift cylinders 260 or alternatively, may be used as an opening through which computer cables, power cords, etc., may be inserted.

Figure 24:
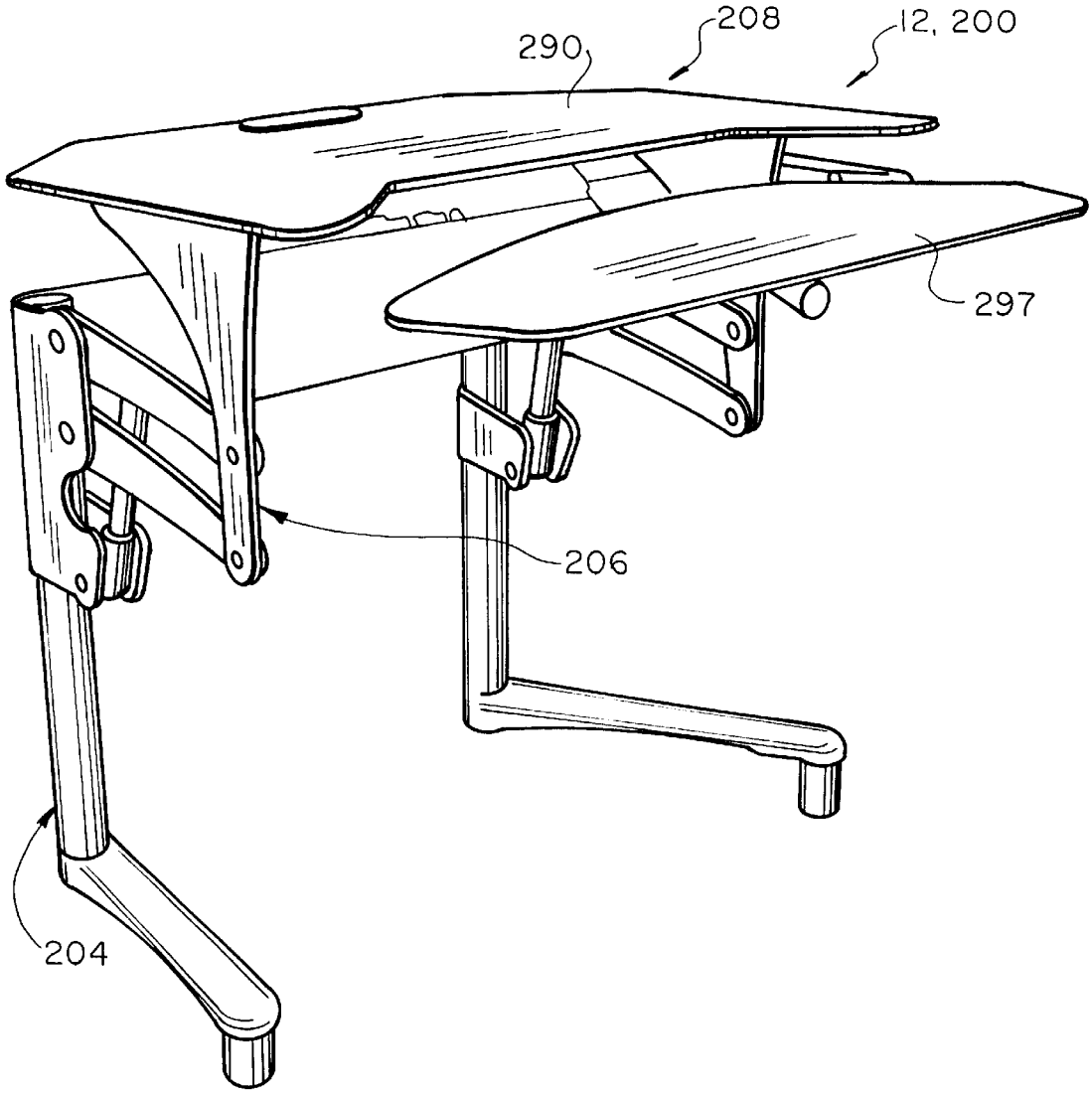
FIG. 24 shows the work station of FIGS. 21–23 wherein the work surface of the work station includes an additional articulating keyboard/work surface.
Figure 25:
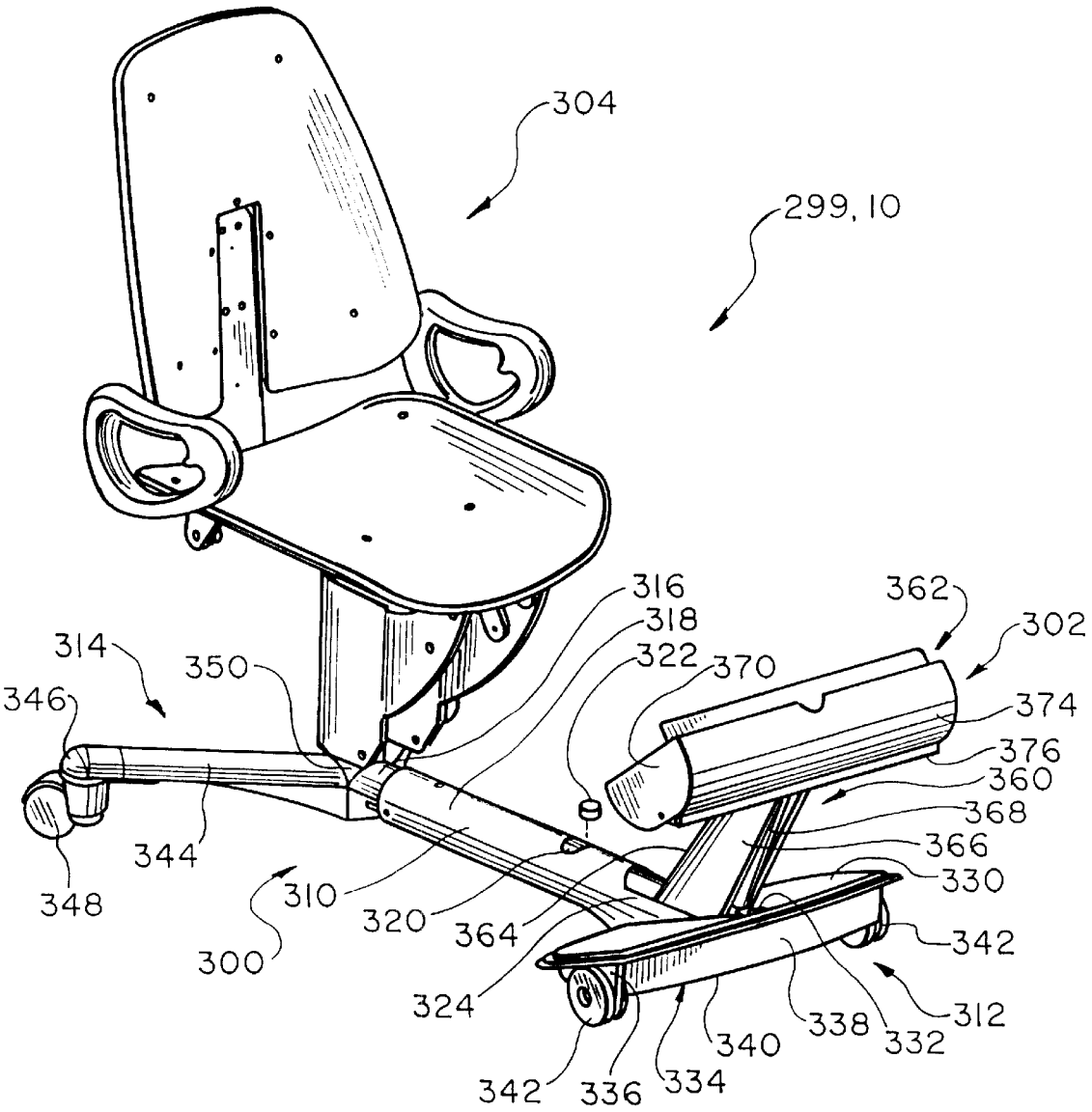
FIG. 25 is a front perspective view of an alternative embodiment of a body positioning system of the present invention.
Figure 26:
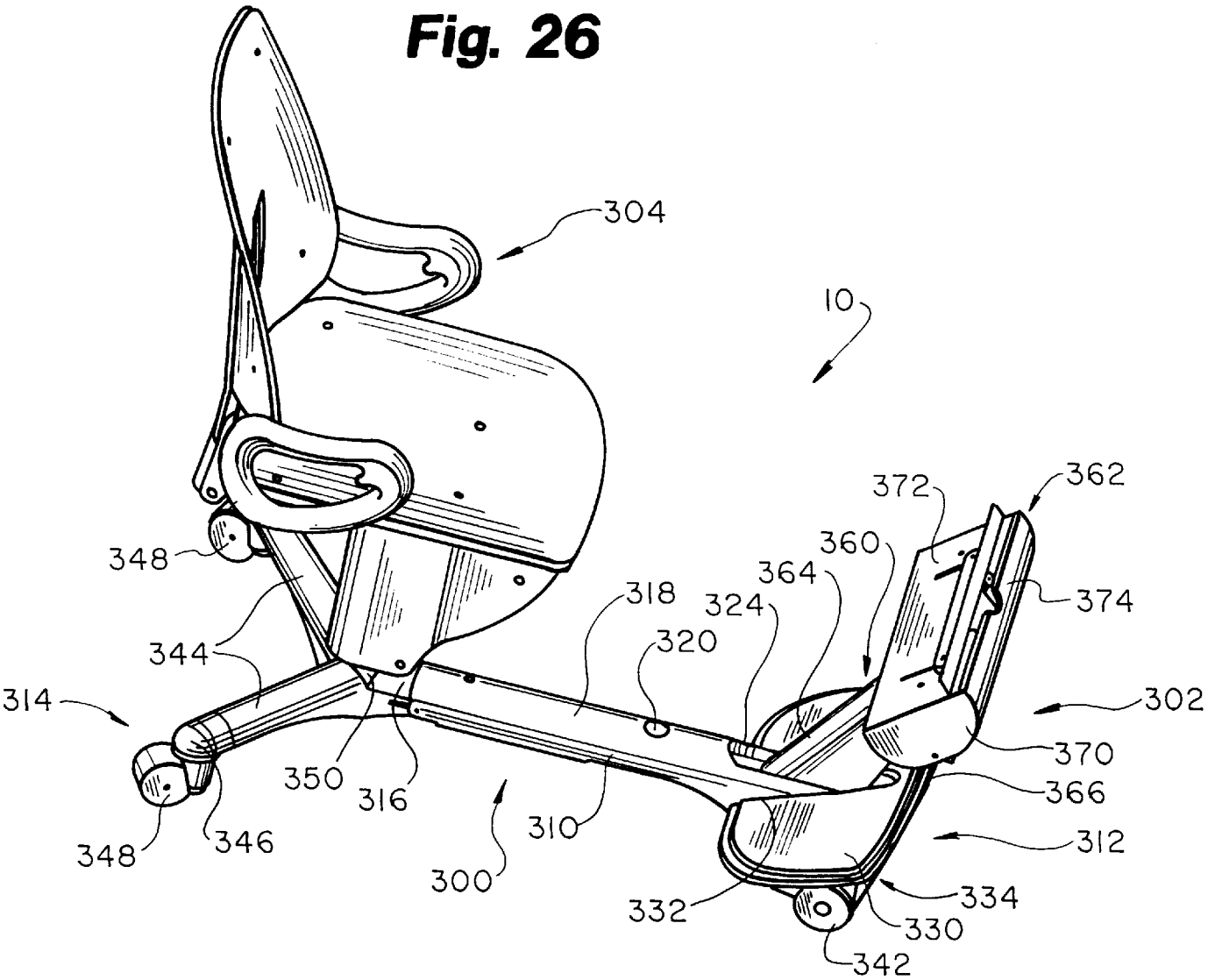
FIG. 26 is a side perspective view of the alternative embodiment of the body positioning system of the present invention.
Figure 27:
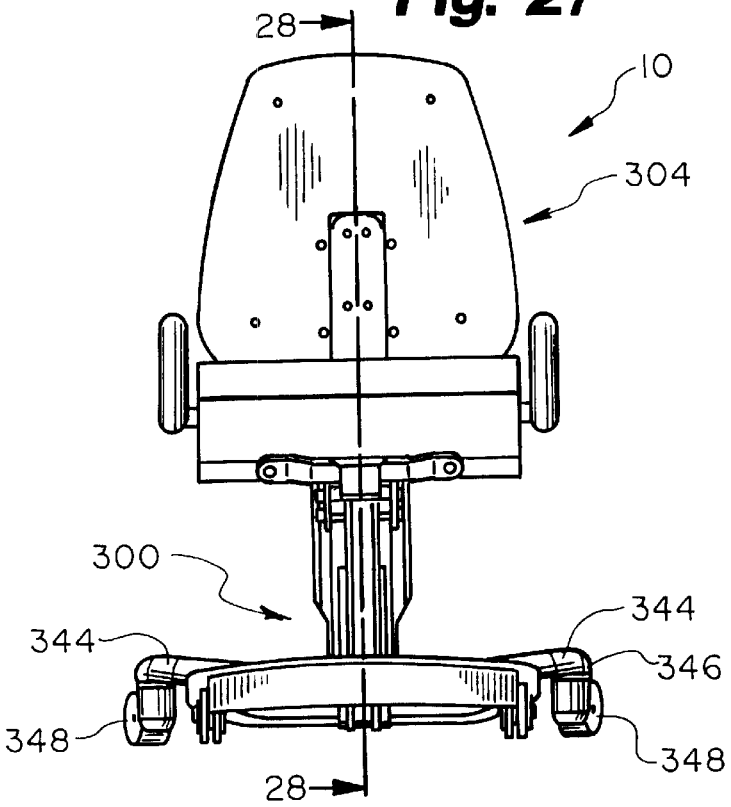
FIG. 27 is a rear plan view of the alternative embodiment of the body positioning system of the present invention.
Figure 28:
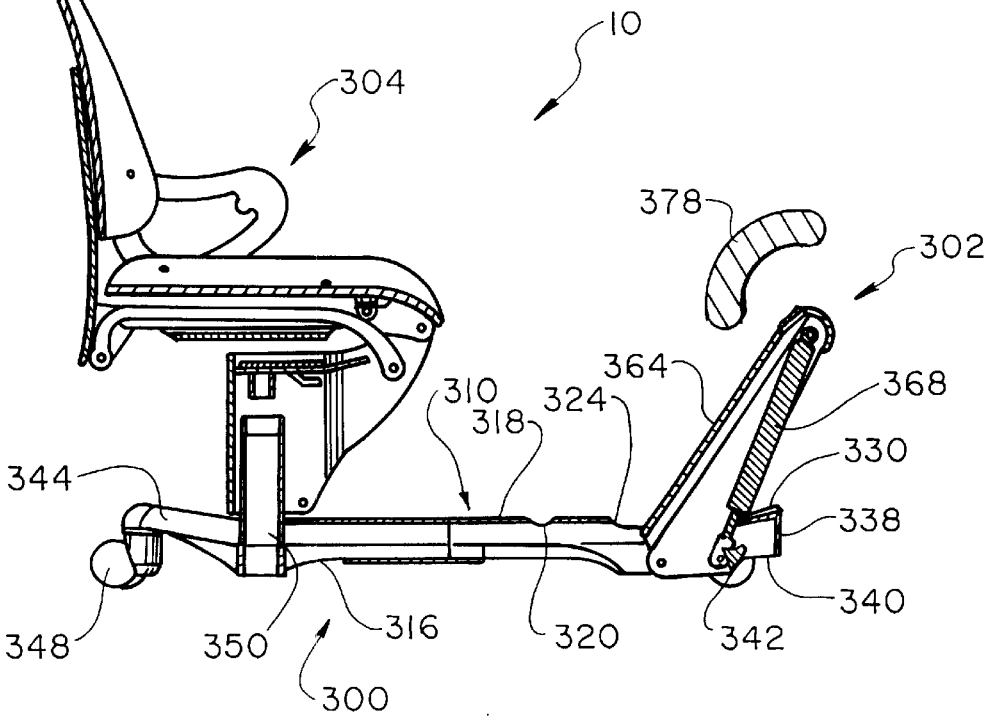
FIG. 28 is a cross-sectional view taken along line A—A of FIG. 27.

Alternatively, rigid work surface 290 may be replaced with a work surface that additionally incorporates an articulating keyboard surface/work surface 297, see FIG. 24 like those available from Ergonomic Concepts of Raleigh, N.C. With the addition of an articulating keyboard surface/work surface 297, slide adjustment assembly 266 may be replaced with a simple rigid member fixedly secured between main lift arms 262 or any semblance thereof may be eliminated completely. However, as with table surface 284, surface 297 is preferably provided with the ability of angular adjustment, i.e., tilting.

FIGS. 25–28 depict an alternative embodiment 299 of body positioning system 10, the location of which may be established independently of the location of the work station 12. As shown, body positioning system 10 generally includes a base structure 300, a knee-support assembly 302, and an adjustable chair structure 304.

Base structure 300 includes a central member 310 that is supported between a T-end portion 312 and a Y-end portion 314. Central member 310 is preferably a telescoping member having inner portion 316 that is slidably adjustable within an outer portion 318 of member 310. The telescoping nature of central member 310 allows each user to determine their preferred distance of chair structure 304 to knee-support assembly 302. Once at a preferred distance, outer portion 318 is preferably secured to inner portion 316 to prevent undesirable movement of central member 310. Outer portion 318 of member 310 preferably includes an aperture 320 to allow for positioning of a depressible foot pedal 322 and an elongate aperture 324 configured to allow for movement of knee-support assembly 302.

T-end portion 312 of base structure 300 includes an angled face plate 330 for supporting and positioning a user's feet. Angled face plate 330 includes a central recess 332 allowing face plate 330 to be positioned about central member 310 and knee-support assembly 302. Face plate 330 is supported by a box structure 334 having a pair of side panels 336, a rear panel 338, and a lower panel 340. A pair of wheels 342 are secured to and operate to support T-end portion 312.

Y-end portion 314 of base structure 300 includes a pair of elongate arms 344 that extend angularly from inner portion 316 of base structure 300. Each elongate arm 344 includes a downward extending nose portion 346 to which is secured a swiveling caster 348. Y-end portion 314 further provides a central shaft 350 to which is secured adjustable chair structure 304.

Knee-support assembly 302 includes a central support member 360 and lateral knee support 362. Central support member 360 includes a front plate 364 and a pair of side plates 366. The rear of central support member 360 remains open allowing central support member 360 to house, at least in part, air cylinder 368. Air cylinder 368 is pivotally connected at one end to central support member 360 and at its other end to box structure 334 of T-end portion 312. The pivotal connection of air cylinder 368 allows knee-support assembly 302 to be moved forward and back as desired using foot pedal 322, which is operably connected to air cylinder 368. Specifically, depressing foot pedal 322 operates air cylinder 368 such that knee-support assembly 302 is moved towards chair structure 304. Releasing foot pedal 322 operates to stop movement of knee-support assembly 302. Knee-support assembly 302 is moved backward by manually pushing assembly 302 back towards T-end portion 312.

Lateral knee support 362 is generally semi-circular in shape having a pair of side plates 370, a planar front plate 372, a rounded rear portion 374, and an open lower portion 376 that allows for insertion of the upper portion of central support member 360. Lateral knee support 362 is preferably pivotally secured to central support member 360 allowing the user to angularly adjust lateral knee support 362. A rounded cushion 378 preferably covers front plate 372 and a portion of rounded rear portion 374, as shown.

Adjustable chair structure 304 is substantially identical to the chair structure of earlier-described body positioning systems 10, incorporating their components and manner of operation, however, adjustable chair structure 304 is supported by central shaft 350 of base structure 300 rather than by pedestal 20 of the earlier embodiments. As such, adjustable chair structure 304 in combination with base structure 300 and knee-support assembly 302 cooperate as body positioning system 10 to alternate between the "seated", "breath-easy", and "lean/stand" positions of FIG. 14.

Figure 29:
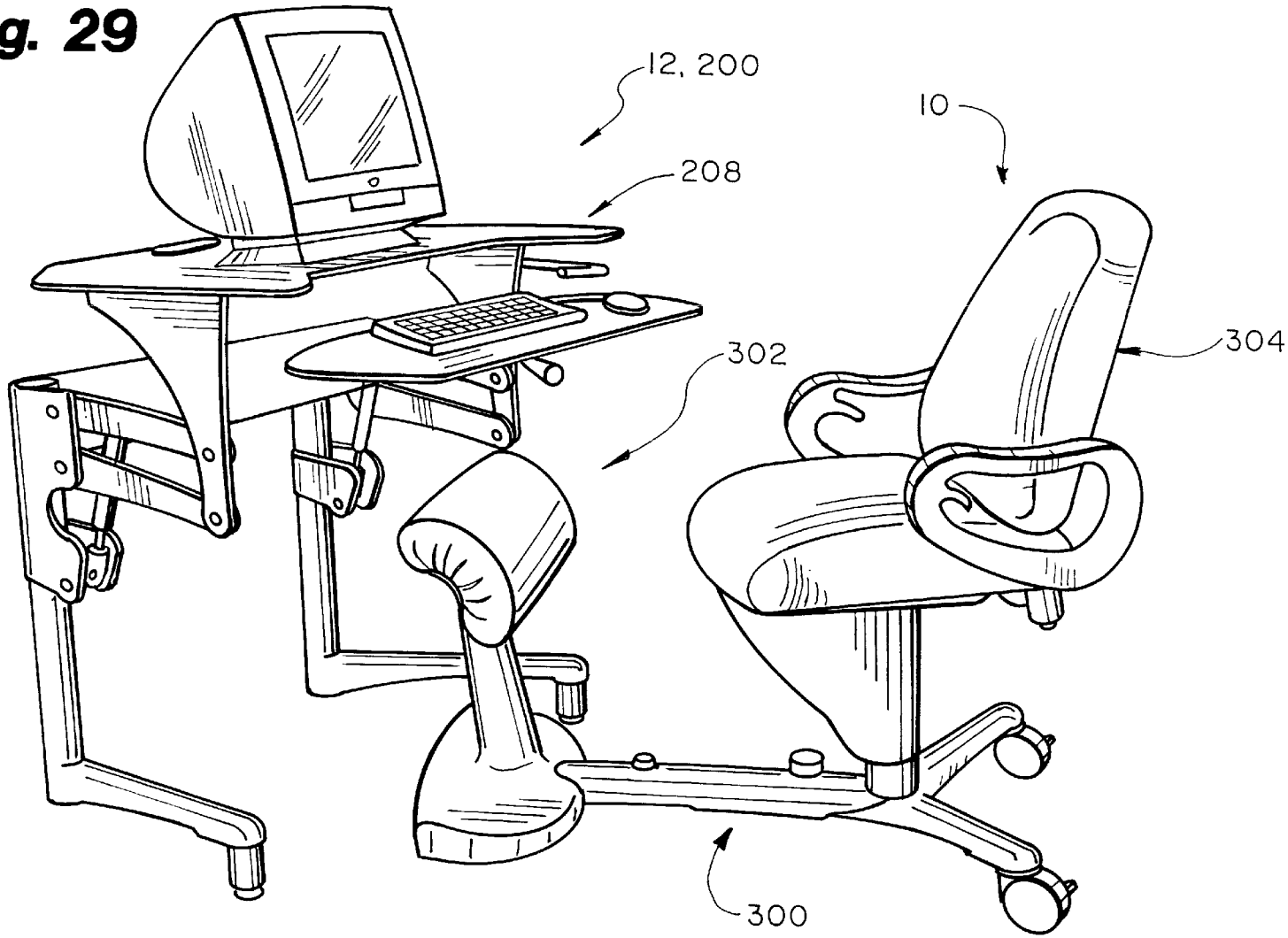
FIG. 29 is an ensemble depiction of the work station of FIGS. 21–24 and the body positioning system of FIGS. 25–28 wherein both are in a seated operating position.
Figure 30:
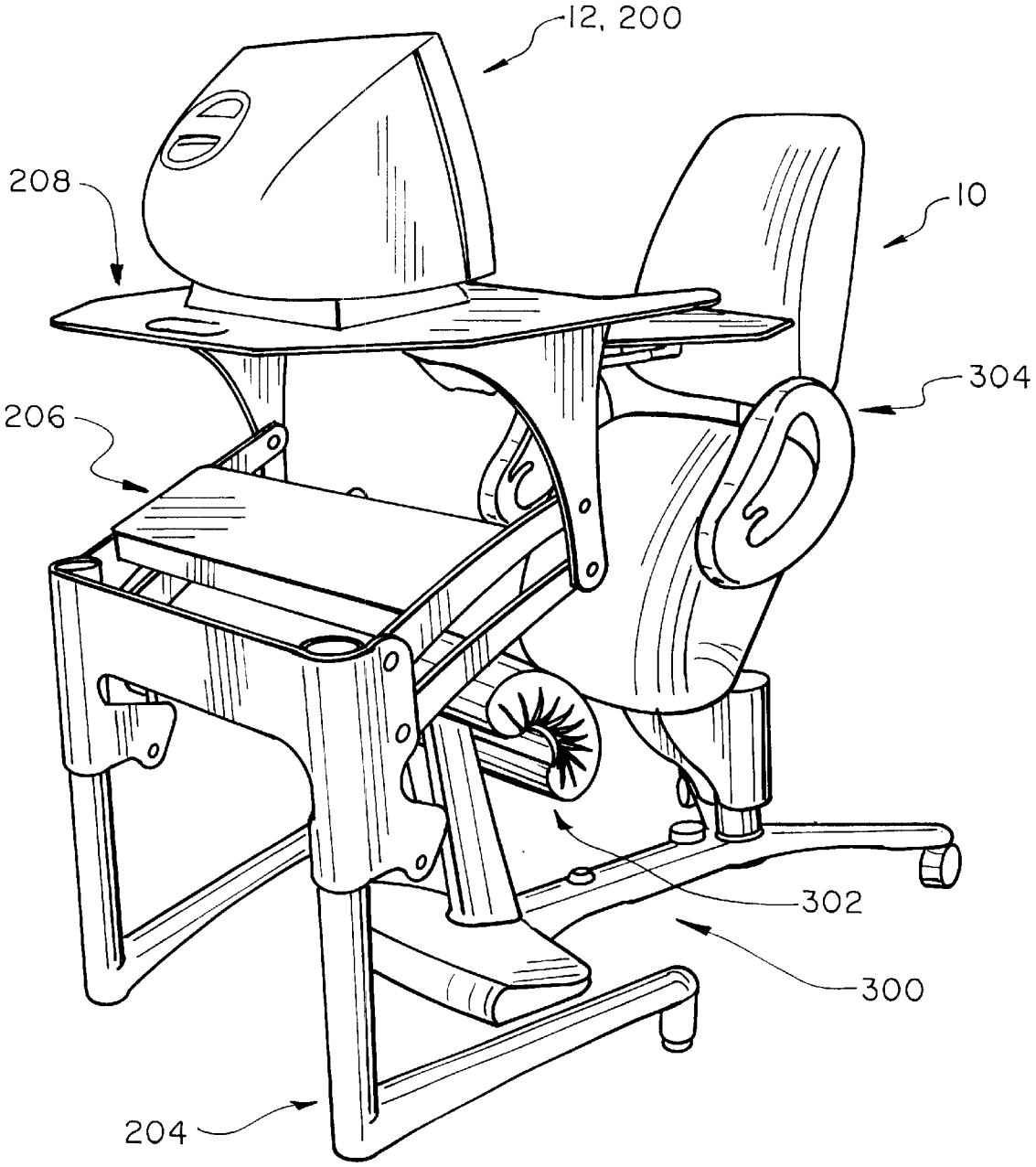
FIG. 30 is an ensemble depiction of the work station of FIGS. 21–24 and the body positioning system of FIGS. 25–28 wherein both are in a seated operating position.

FIG. 29 depicts embodiment 200 of work station 12 and embodiment 299 of body positioning system 10 in a seated working position where body positioning system 10 is positionable relative the position of work station 12. FIG. 30 depicts embodiment 200 of work station 12 and embodiment 299 of body positioning system 10 in a lifted working position, e.g., the "breath-easy" or "lean/stand" position.

While the preferred embodiments of the present invention have been shown and described, it will be obvious to those skilled in the art that changers, variations and modifications may be made therein without departing from the present invention in its broader aspects.

Thus, although the present invention has been described with reference to preferred embodiments, workers skilled in the art will recognize that changes may be made in form and detail without departing from the spirit and scope of the invention in its broader aspects and, therefore, the aim in the appended claims is to cover such changes and modifications as fall within the scope and spirit of the invention.

What is claimed is:

1. A body positioning system, comprising:

a chair structure assembly containing a backrest and pressure-bearing surface couplably interconnected by a parallel linkage assembly, the parallel linkage assembly including a piston assembly coupled to the pressure-bearing surface and spaced laterally from the backrest;

a knee-support assembly; and a support structure having a plurality of wheels for repositioning said support structure, wherein said support structure supports said chair structure and said knee-support assembly in a co-linear orientation, and, wherein the supported chair structure assembly, in combination with the supported knee-support assembly and support structure, is adjustable to provide a seated work position and a lifted work position while at all times maintaining a substantially perpendicular orientation of the back rest to the floor, and wherein the piston assembly is coupled to the support structure and is adapted to extend the parallel linkage assembly when the chair support assembly is in the lifted work position thereby placing the pressure bearing surface in a substantially co-planar relation with the back rest.

2. The body positioning system of claim 1, wherein said knee-support assembly is adjustable in distance from said chair structure along the line of said co-linear orientation.

3. The body positioning system of claim 1, wherein said knee-support assembly is rotatably adjustable.

4. The body positioning system of claim 1, wherein said support structure includes an angled foot plate positioned below said knee-support assembly.

5. The body positioning system of claim 1, wherein said knee-support assembly includes an air cylinder.

6. The body positioning system of claim 5, wherein said air cylinder aids in the linear adjustment of said knee-support assembly relative said chair support.

7. The body positioning system of claim 1, wherein said support structure is linearly adjustable.

8. A body positioning system comprising:

body support means for supporting the torso of a human user;

knee support means for supporting the knees of a human user;

means for supporting said body support means and said knee support means in a co-linear orientation, said means for supporting including rolling repositioning means for repositioning said body positioning system at a desired location, wherein said body support means, in combination with said knee support means, is positionable between a seated work position and a lifted work position, wherein said body support means has a back rest operably coupled via a parallel linkage to a seat, the parallel linkage assembly including a piston assembly coupled to the seat and spaced laterally from the back rest, said back rest maintaining a substantially perpendicular orientation to the floor throughout the range of body support positions between the seated work position and the lifted work position, wherein the piston assembly is coupled to the means for supporting said body support means and is adapted to extend the parallel linkage assembly when the body support means is in the lifted work position thereby placing the seat in a substantially co-planar relation with the back rest.

9. The body positioning system of claim 8, wherein said knee support means is adjustable in distance from said body support means along the line of said co-linear orientation.

10. The body positioning system of claim 8, wherein said knee support means includes adjustment means for rotatably adjusting said knee support means.

11. The body positioning system of claim 8, wherein said means for supporting includes foot support means for supporting the feet of a human user.

12. The body positioning system of claim 8, wherein said knee support means includes pneumatic assist means for assisting in adjusting said knee support means relative said body support mean.

13. The body positioning system of claim 8, wherein said means for supporting is linearly adjustable.

* * * * *

UNITED STATES PATENT AND TRADEMARK OFFICE

CERTIFICATE OF CORRECTION

PATENT NO. : 6,439,657 B1
DATED : August 27, 2002
INVENTOR(S) : Tholkes

It is certified that error appears in the above-identified patent and that said Letters Patent is hereby corrected as shown below:

Title page,
Item [57], ABSTRACT,
Line 7, delete “Tie” and insert -- The --.

Column 2,
Line 4, delete the second occurrence of “of the”.
Line 24, after “structures” insert -- that --.
Line 38, delete “lings” and insert -- lungs --.

Column 3,
Line 13, after “alia” insert -- , --.

Column 4,
Line 41, delete “mechanism” and insert -- mechanisms --.

Column 8,
Line 10, delete “adjustably” and insert -- adjustable --.
Line 49, after “orientation” delete “.”.

Column 10,
Line 28, delete “shits” and insert -- shifts --.

Column 11,
Line 25, delete “11” and insert -- 111 --.

Column 15,
Line 54, delete “changers,” and insert -- changes, --.

UNITED STATES PATENT AND TRADEMARK OFFICE

CERTIFICATE OF CORRECTION

PATENT NO. : 6,439,657 B1
DATED : August 27, 2002
INVENTOR(S) : Tholkes

It is certified that error appears in the above-identified patent and that said Letters Patent is hereby corrected as shown below:

Column 17,
Line 4, delete "mean." and insert -- means. --

Signed and Sealed this

Fourth Day of November, 2003

JAMES E. ROGAN
*Director of the United States Patent and Trademark Office*